US006806836B2

(12) United States Patent
Ogawa et al.

(10) Patent No.: US 6,806,836 B2
(45) Date of Patent: Oct. 19, 2004

(54) HELICAL ANTENNA APPARATUS PROVIDED WITH TWO HELICAL ANTENNA ELEMENTS, AND RADIO COMMUNICATION APPARATUS PROVIDED WITH SAME HELICAL ANTENNA APPARATUS

(75) Inventors: Koichi Ogawa, Osaka (JP); Hiroshi Iwai, Osaka (JP); Yoshio Koyanagi, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 77 days.

(21) Appl. No.: 10/369,754

(22) Filed: Feb. 21, 2003

(65) Prior Publication Data

US 2003/0174100 A1 Sep. 18, 2003

(30) Foreign Application Priority Data

Feb. 22, 2002 (JP) ..... P2002-046032

(51) Int. Cl.[7] ..... H01Q 1/24; H01Q 1/36

(52) U.S. Cl. ..... 343/702; 343/745; 343/895

(58) Field of Search ..... 343/702, 895, 343/718, 745, 802, 822, 747

(56) References Cited

U.S. PATENT DOCUMENTS 6,137,445 A * 10/2000 Ha et al. ..... 343/702

6,459,412 B1 * 10/2002 Koyanagi et al. ..... 343/702

OTHER PUBLICATIONS

Koichi Ogawa et al., "An Analysis of the Effective Radiation Efficiency of the Normal Mode Helical Antenna Close to the Human Abdomen at 150 MHz and Consideration of Efficiency Improvement", The Transactions of the Institute of Electronics, Information and Communication Engineers in Japan, (B) vol. J84–B, No. 5, pp. 902–911, May, 2001 together with an English translation thereof.

* cited by examiner

*Primary Examiner*—Michael C. Wimer
(74) *Attorney, Agent, or Firm*—Wenderoth, Lind & Ponack, L.L.P.

(57) ABSTRACT

In a helical antenna apparatus, a first variable capacitance element is connected between a first helical antenna element and a second helical antenna element, and a second variable capacitance element is connected between a first terminal of a balanced port of a balanced to unbalanced transformer and the first helical antenna element. A third variable capacitance element is connected between a second terminal of the balanced port of the balanced to unbalanced transformer and the second helical antenna element. A detector measures a detection voltage Vd corresponding to a reflected power of a reflected signal reflected from the first and second helical antenna elements when the first and second helical antenna elements are fed with a transmission signal from a radio transmitter, and an adaptive controller adaptively controls respective capacitance values of the first to third variable capacitance elements.

39 Claims, 25 Drawing Sheets

FIRST PREFERRED EMBODIMENT

FOURTH PREFERRED EMBODIMENT

SECOND PREFERRED EMBODIMENT

THIRD PREFERRED EMBODIMENT

CHANGE IN IMPEDANCE MATCHING STATE DUE TO HUMAN BODY COMING NEAR

IN FREE SPACE

CLOSE TO HUMAN BODY (D=2.5cm)

CHANGE IN IMPEDANCE MATCHING STATE DUE TO ADAPTIVE CONTROL

BEFORE ADAPTIVE CONTROL (D=2.5cm)

AFTER ADAPTIVE CONTROL (D=2.5cm)

MODIFIED PREFERRED EMBODIMENT OF THIRD PREFERRED EMBODIMENT

FOURTH PREFERRED EMBODIMENT

MODIFIED PREFERRED EMBODIMENT OF FIRST PREFERRED EMBODIMENT

MODIFIED PREFERRED EMBODIMENT OF THIRD PREFERRED EMBODIMENT

HELICAL ANTENNA APPARATUS PROVIDED WITH TWO HELICAL ANTENNA ELEMENTS, AND RADIO COMMUNICATION APPARATUS PROVIDED WITH SAME HELICAL ANTENNA APPARATUS

BACKGROUND OF THE INVENTION

1. Field of the Invention

The present invention relates to a helical antenna apparatus provided with two helical antenna elements, and to a radio communication apparatus provided with the same helical antenna apparatus. In particular, the present invention relates to a helical antenna apparatus for use in a mobile radio system, such as, mainly in a portable telephone, a radio transceiver for business use or the like, and a radio communication apparatus provided with the same antenna apparatus.

2. Description of the Prior Art

FIG. 22 is a perspective view showing one example of a situation in which a prior art portable radio transceiver 101 for business use is used. The VHF band of 150 MHz to 450 MHz is assigned as a radio frequency to the portable radio transceiver 101 for business use. Therefore, a normal-mode helical antenna apparatus 102 attached to the portable radio transceiver 101 is often employed as an antenna as shown in FIG. 22.

FIG. 23 is a circuit diagram showing an equivalent circuit of the helical antenna apparatus 102 for use in the portable radio transceiver 101 for business use of FIG. 22, and FIG. 23 includes an image of the helical antenna apparatus 102 of FIG. 22 inside of a radio transceiver housing.

Referring to FIG. 23, a helical antenna element 1 and a helical antenna element 2 are constituted so as to be symmetrical with respect to a feeding point, and have the same size parameters (winding diameter, number of turns, winding pitch) as those of each other. In this case, a capacitance element 3*a* having a predetermined fixed electrostatic capacity is connected between the helical antenna element 1 and the helical antenna element 2. By the capacitance element 3*a* and a balanced to unbalanced transformer 6, impedance matching is achieved between an input impedance Za of the helical antenna apparatus 102 and a coaxial cable 7 of a transmission line, and an impedance of the helical antenna apparatus 102 seen from an input connector 8 is set so as to become 50Ω (See, for example, a prior art document of "Koichi Ogawa et al., "An Analysis of the Effective Radiation Efficiency of the Normal Mode Helical Antenna Close to the Human Abdomen at 150 MHz and Consideration of Efficiency Improvement", The Transactions of the Institute of Electronics, Information and Communication Engineers in Japan, (B), Vol. J84-B, No.5, pp.902–911, May, 2001).

FIG. 24 is a graph showing a frequency characteristic of a voltage standing wave ratio (VSWR) in the helical antenna apparatus 102 of FIG. 23, and FIG. 24 illustrates the impedance characteristic of the helical antenna apparatus 102 designed for the 150 MHz band portable radio transceiver for business use. In this graph, the helical antenna elements 1 and 2 have a length of about 10 cm, and have an average shape as a portable radio transceiver on the market. As shown in FIG. 24, there is achieved an extremely good impedance matching state in which the VSWR is almost one at 150 MHz. However, the bandwidth in which the VSWR is equal to or smaller than two is within a range of 2 MHz, and this represents an extremely narrow band characteristic.

In general, the frequency assigned to the portable radio transceiver for business use has a range of 10 MHz and higher. Therefore, according to the impedance characteristic shown in FIG. 24, there arise such a problem that the actual gain of the helical antenna apparatus 102 is significantly reduced due to an impedance mismatching loss when the antenna apparatus is used at a frequency other than the frequency at which matching is achieved. In order to cope with this problem, the current measures are to prepare a plurality of helical antenna elements that have different center frequencies and obtain satisfactory impedance with respect to all the frequencies by replacing the antenna according to the operation frequency. As described above, the first problem of the helical antenna for business radio use is that that the impedance characteristic has a narrow range.

The feature in use of the portable radio transceiver for business use is that the radio transceiver is mounted on a human body so as not to hinder the business in a manner different from that of the portable telephone and the like. Upon having a telephone conversation using the radio transceiver, the user utilizes a microphone and an earphone as shown in FIG. 22. At this time, as is apparent from FIG. 22, the helical antenna apparatus 102 is brought into contact with the abdomen of the user 103. The antenna characteristics in this situation are described in detail in, for example, the above-mentioned prior art document, which was written by the present inventor and the others. The outline thereof will be described below.

FIG. 25A is a perspective view showing a positional relation between the helical antenna apparatus 102 and a human body model 201 of FIG. 23, and FIG. 25B is a Smith chart showing a range dependence characteristic of the input impedance Za of the helical antenna apparatus 102 of FIG. 23.

As shown in FIG. 25A, the helical antenna apparatus 102 is located so as to be close to the human body model 201 of an elliptic columnar configuration but be separated at a distance D. FIG. 25B shows calculated values of the input impedance Za when the distance D between the helical antenna apparatus 102 and the human body is changed, and the frequency is 150 MHz. As shown in FIG. 25B, the input impedance Za has its inductive reactance increasing as the helical antenna apparatus 102 approaches the human body. This is attributed to that the mutual inductance has equivalently increased as the results of an electromagnetic interaction between the helical antenna apparatus 102 and the human body.

FIG. 26 is a graph showing a loss power ratio with respect to the distance D between the human body and the antenna of the helical antenna apparatus 102 of FIG. 23, and FIG. 26 shows calculation results of various power losses of the helical antenna apparatus 102 appearing as the result of the impedance change shown in FIGS. 25A and 25B.

Referring to FIG. 26, Pt represents the summation of power losses, Pm represents a power loss due to impedance mismatching, Pa represents a power loss due to the metal resistance of the antenna, and Ph represents a power loss due to the electromagnetic absorption of the human body. The horizontal axis of FIG. 26 represents the distance D between the antenna and the human body, and the vertical axis represents the rate of each power loss (loss power ratio) with respect to the summation Pt of the power losses.

As is apparent from FIG. 26, if the helical antenna apparatus 102 approaches the human body, then the impedance mismatching loss Pm comes to share the greater part of the whole loss power in comparison with the metal conductor loss Pa of the antenna and the absorption power loss Ph of the human body. This is caused due to that the input impedance Za of the helical antenna apparatus 102 becomes remarkably large inductive as the distance D decreases, as shown in FIG. 25B. As the result of FIG. 26, the prior art document analytically describes that the radiation efficiency at a distance of D=2 cm has an extremely low value of equal to or smaller than −20 dB.

As is comprehensible from the above-mentioned analytical results, the other problem of the helical antenna apparatus 102 of FIG. 22 is an increase in power loss due to impedance mismatching in a situation in which a human body is located so as to be close to the apparatus.

As described above, the helical antenna apparatus 102 for business radio use has the following two problems. The first problem is the narrow range of the impedance characteristic, and the second problem is the increase in power loss due to impedance mismatching when a human body is located so as to be close to the apparatus. These two problems are each attributed to the impedance mismatching between the input impedances Za of the helical antenna apparatus 102 and the impedance of the transmission line connected to the helical antenna apparatus 102.

However, in the helical antenna apparatus 102 of the prior art example shown in FIG. 23, the impedance matching has been achieved only at the specified frequency predetermined in free space, and this has therefore led to such a problem that the impedance frequency characteristic has had a narrow range. Furthermore, there has been such a problem that, in the situation in which the helical antenna apparatus 102 has been located so as to be close to a human body, the mismatching situation has been promoted by the electromagnetic interaction between the helical antenna apparatus 102 and the human body even at the frequency at which the impedance matching is achieved in free space and the actual gain of the antenna has been significantly reduced.

SUMMARY OF THE INVENTION

An essential object of the present invention is to solve the above-mentioned problems and provide a helical antenna apparatus, capable of being used in a wide band and of reducing the power loss due to impedance mismatching when the antenna is located so as to be close to a human body, and a radio communication apparatus provided with the same helical antenna apparatus.

In order to achieve the above-mentioned objective, according to one aspect of the present invention, there is provided a helical antenna apparatus connected to either one of a balanced feeder line and a balanced port of a balanced to unbalanced transformer of a feeder circuit. The helical antenna apparatus includes a first helical antenna element, a second helical antenna element, first to third variable capacitance elements. The first variable capacitance element is connected between the first helical antenna element and the second helical antenna element, and the second variable capacitance element is connected between (a) either one of the balanced feeder line and a first terminal of the balanced port of the balanced to unbalanced transformer, and (b) the first helical antenna element. The third variable capacitance element is connected between (a) either one of the balanced feeder line and a second terminal of the balanced port of the balanced to unbalanced transformer, and (b) the second helical antenna element.

The above-mentioned helical antenna preferably further includes a detector and an adaptive controller. The detector is connected between (a) either one of the balanced feeder line and the feeding port of the balanced to unbalanced transformer, and (b) a radio transmitter. The detector detects at least one detection value of a reflection signal reflected from the first and second helical antenna elements when the first and second helical antenna elements are fed with a transmission signal from the radio transmitter, a reflection coefficient and a voltage standing wave ratio. The adaptive controller adaptively controls respective capacitance values of the first, second and third variable capacitance elements, so that either one of the detected detection value and a predetermined estimation function including the reflection signal becomes substantially minimized.

According to another aspect of the present invention, there is provided a helical antenna apparatus connected to an unbalanced feeder line, and provided on a radio communication apparatus housing. The helical antenna apparatus includes a helical antenna element, and first and second variable capacitance elements. The first variable capacitance element is connected between the helical antenna element and the radio communication apparatus housing, and the second variable capacitance element connected between the unbalanced feeder line and the helical antenna element.

The above-mentioned helical antenna apparatus preferably further includes a detector and an adaptive controller. The detector is connected between the unbalanced feeder line and a radio transmitter, and the detector detects at least one detection value of a reflection signal reflected from the helical antenna element when the helical antenna element is fed with a transmission signal from the radio transmitter, a reflection coefficient and a voltage standing wave ratio. The adaptive controller adaptively controls respective capacitance values of the first and second variable capacitance elements, so that either one of the detected detection value and a predetermined estimation function including the reflection signal becomes substantially minimized.

According to a further aspect of the present invention, there is provided a radio communication apparatus, which includes a helical antenna apparatus, a radio transmitter, a radio receiver. The helical antenna apparatus is connected to either one of a balanced feeder line and a balanced port of a balanced to unbalanced transformer of a feeder circuit. The radio transmitter is connected to the helical antenna apparatus, and the radio receiver connected to the helical antenna apparatus. The helical antenna apparatus includes first and second antenna elements and first to third variable capacitance elements. The first variable capacitance element is connected between the first helical antenna element and the second helical antenna element. The second variable capacitance element is connected between (a) either one of the balanced feeder line and a first terminal of the balanced port of the balanced to unbalanced transformer, and (b) the first helical antenna element. The third variable capacitance element is connected between (a) either one of the balanced feeder line and a second terminal of the balanced port of the balanced to unbalanced transformer, and (b) the second helical antenna element.

In the above-mentioned radio communication apparatus, the helical antenna apparatus further includes a detector and an adaptive controller. The detector is connected between (a) either one of the balanced feeder line and the feeding port of the balanced to unbalanced transformer, and (b) a radio transmitter, and the detector detects at least one detection value of a reflection signal reflected from the first and second helical antenna elements when the first and second helical antenna elements are fed with a transmission signal from the radio transmitter, a reflection coefficient and a voltage standing wave ratio. The adaptive controller adaptively controls respective capacitance values of the first, second and third variable capacitance elements, so that either one of the detected detection value and a predetermined estimation function including the reflection signal becomes substantially minimized.

The above-mentioned radio communication apparatus further includes a controller apparatus, which controls operation of the radio transmitter and the radio receiver, wherein the controller apparatus includes the adaptive controller.

According to a still further aspect of the present invention, there is provided a radio communication apparatus which includes a helical antenna apparatus connected to an unbalanced feeder line and provided on a radio communication apparatus housing, a radio transmitter connected to the helical antenna apparatus and a radio receiver connected to the helical antenna apparatus. The helical antenna apparatus includes a helical antenna element, and first and second variable capacitance elements. The first variable capacitance element is connected between the helical antenna element and the radio communication apparatus housing, and the second variable capacitance element connected between the unbalanced feeder line and the helical antenna element.

In the radio communication apparatus, the helical antenna apparatus preferably further includes a detector and an adaptive controller. The detector is connected between the unbalanced feeder line and a radio transmitter, and the detector detects at least one detection value of a reflection signal reflected from the helical antenna element when the helical antenna element is fed with a transmission signal from the radio transmitter, a reflection coefficient and a voltage standing wave ratio. The adaptive controller adaptively controls respective capacitance values of the first and second variable capacitance elements, so that either one of the detected detection value and a predetermined estimation function including the reflection signal becomes substantially minimized.

The above-mentioned radio communication apparatus preferably further includes a controller apparatus, which controls operation of the radio transmitter and the radio receiver, wherein the controller apparatus includes the adaptive controller.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
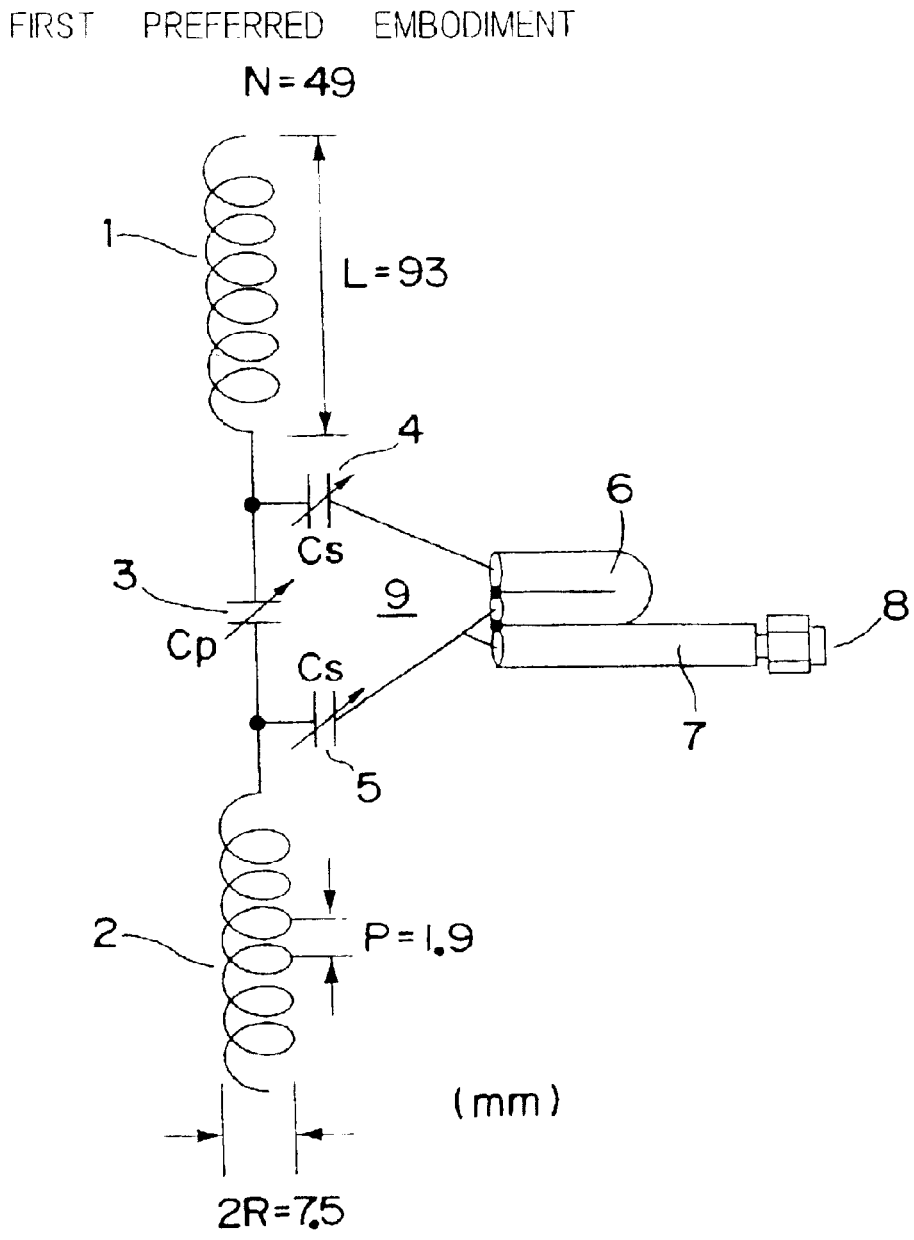
FIG. 1 is a circuit diagram showing a construction of a helical antenna apparatus according to a first preferred embodiment of the present invention.

Preferred embodiments of the present invention will be described below with reference to the drawings. In the accompanying drawings, similar components are denoted by the same reference numerals.

First Preferred Embodiment

FIG. 1 is a circuit diagram showing a construction of a helical antenna apparatus according to the first preferred embodiment of the present invention. The helical antenna apparatus of this first preferred embodiment is provided with two helical antenna elements 1 and 2. A variable capacitance element 3 having a capacitance value Cp is connected between mutually opposed ends of the helical antenna elements 1 and 2. A variable capacitance element 4 having a capacitance value Cs is connected between (a) a central conductor located at one end of a balanced to unbalanced transformer 6 constructed of a coaxial cable having a half wavelength and a part of a coaxial cable 7, and (b) the one end of the helical antenna element 1. A variable capacitance element 5 having the capacitance value Cs is connected between (a) a connection point of the central conductor located at the other end of the balanced to unbalanced transformer 6 and one end of the coaxial cable 7 of a feeder line, and (b) the one end of the helical antenna element 2. These variable capacitance elements 3, 4 and 5 constitute an impedance matching circuit 9.

Referring to FIG. 1, an input connector 8 is connected to a radio transmitter (not shown), and is connected to the coaxial cable 7 of the feeder line. The central conductor located at the other end of the coaxial cable 7 and the central conductor located at the other end of the balanced to unbalanced transformer 6 of a feeder circuit are connected to each other, and is connected to one end of the variable capacitance element 5. The central conductor located at the one end of the balanced to unbalanced transformer 6 is connected to one end of the variable capacitance element 4. Further, a grounding conductor located at both ends of the balanced to unbalanced transformer 6 and a grounding conductor of the coaxial cable 7 are connected to each other.

In the present preferred embodiment, the balanced to unbalanced transformer 6, which is a U-shaped balun, is employed. A left-hand side port of the balanced to unbalanced transformer 6, which is connected to the variable capacitance elements 4 and 5, becomes a balanced port (antenna side port), and a port thereof located on the coaxial cable 7 side becomes an unbalanced port (feeding port).

In the present preferred embodiment, the two helical antenna elements 1 and 2 have the same size parameters, and are formed with a winding diameter 2R=7.5 mm, a number of turns N=49, a winding pitch P=1.9 mm and an axial length L=93 mm. Moreover, the two helical antenna elements 1 and 2 are formed so as to have mutually opposite winding directions, and the helical antenna apparatus provided with the two helical antenna elements 1 and 2 has electrical symmetry with respect to the feeding point.

The helical antenna elements 1 and 2 of the configuration shown in FIG. 1 are generally called the normal-mode helical antenna elements. The normal-mode helical antenna elements are characterized in that they have a self-resonance action, and the size parameters are normally selected so as to cause a self-resonance. Therefore, the size parameters change depending on the operation frequency. The operation and characteristics in the 150 MHz band frequently used in the portable radio transceiver for business use will be herein described.

Figure 2:
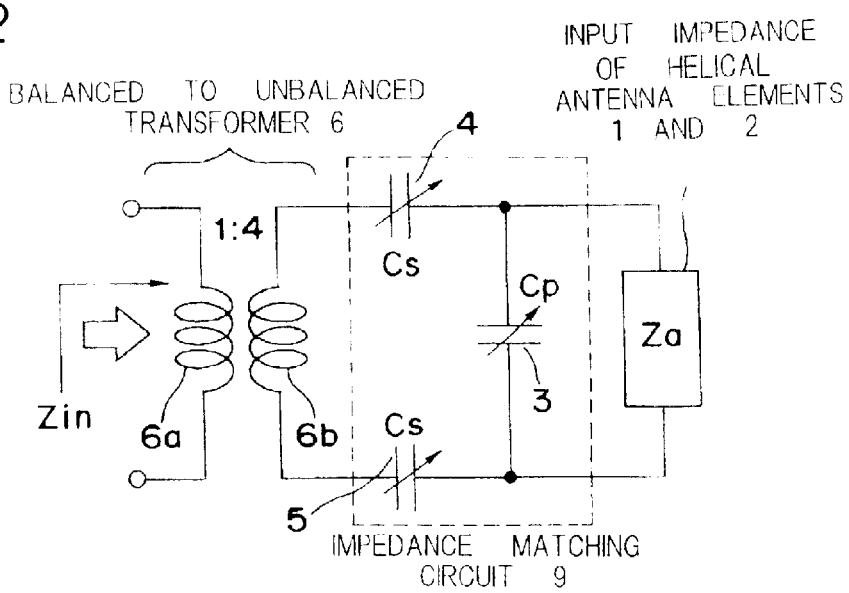
FIG. 2 is a circuit diagram showing an equivalent circuit of a balanced to unbalanced transformer 6 and an impedance matching circuit 9 of FIG. 1.
Figure 3:
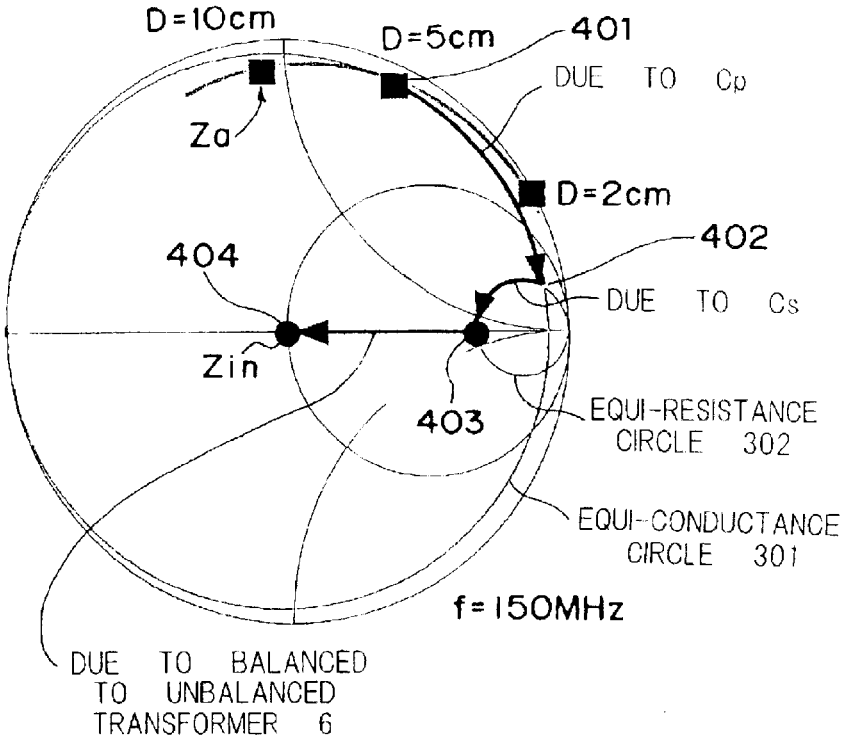
FIG. 3 is a Smith chart showing an impedance matching operation of the helical antenna apparatus of FIG. 1.
Figures 25A, 25B:
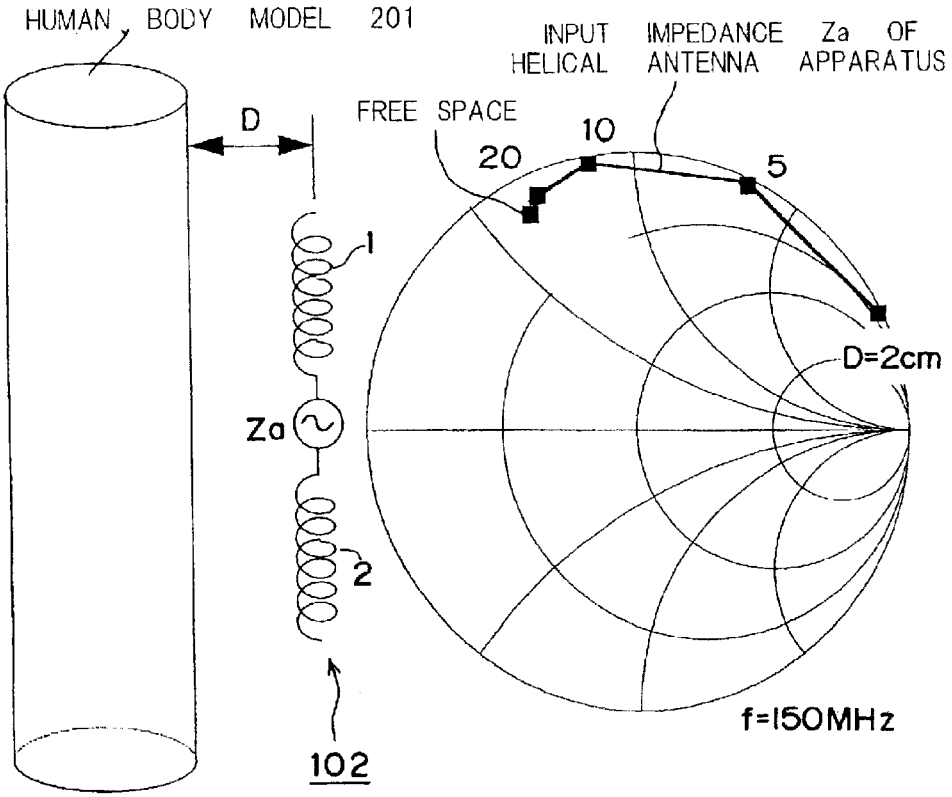
Fig.25A PRIOR ART
Fig.25B PRIOR ART
FIG. 25A is a perspective view showing a positional relation between the helical antenna apparatus 102 and the human body model 201 of FIG. 23.
FIG. 25B is a Smith chart showing a range dependence characteristic of the input impedance Za of the helical antenna apparatus 102 of FIG. 23.
Figure 26:
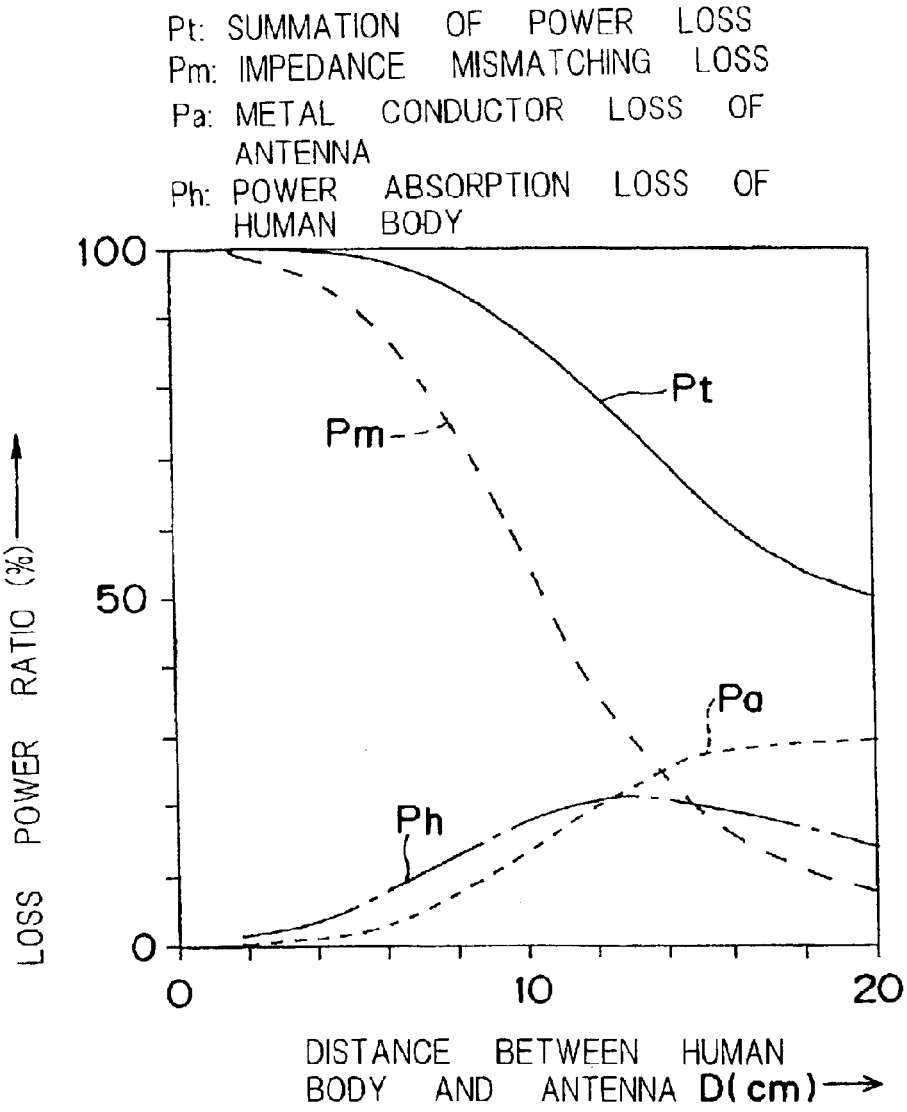
Fig.26 PRIOR ART
FIG. 26 is a graph showing a loss power ratio with respect to a distance D between the human body and the antenna of the helical antenna apparatus 102 of FIG. 23.

FIG. 2 is a circuit diagram showing an equivalent circuit of the balanced to unbalanced transformer 6 and the impedance matching circuit 9 of FIG. 1, and FIG. 3 is a Smith chart showing an impedance matching operation of the helical antenna apparatus of FIG. 1. For the analytical calculation, the human body model 201 of the elliptic columnar configuration shown in FIG. 25A was used.

Referring to FIG. 3, the parameter D is the distance between the antenna and the human body. Further, the size parameters of the helical antenna elements 1 and 2 are selected so as to cause the self-resonance at 150 MHz with a winding diameter of 2R=7.5 mm, the number of turns of N=49, a winding pitch of P=1.9 mm and a winding length of L=93 mm (See FIG. 1).

The equivalent circuit of FIG. 2 is constructed of three main portions, which are the input impedance Za of the helical antenna elements 1 and 2, the impedance matching circuit 9 constructed of the three variable capacitance elements 3, 4 and 5 and the balanced to unbalanced transformer 6 that is the so-called "balun" constructed of a primary winding 6*a* and a secondary winding 6*b*. If a balun having an impedance transformation ratio of 1:4 such as an U-shaped balun is employed as the balanced to unbalanced transformer 6, then an input impedance Zin when the helical antenna apparatus is seen from the input connector 8 (FIG.

1) of the helical antenna apparatus is expressed by the following Equations with reference to FIG. 2.

$$Z_{in} = \frac{1}{4}\left(2Z_{Cs} + \frac{Z_{Cp}Z_a}{Z_{Cp} + Z_a}\right) \quad (1)$$

$$Z_{Cs} = \frac{1}{j\omega C_s} \quad (2)$$

$$Z_{Cp} = \frac{1}{j\omega C_p} \quad (3)$$

where, $Z_{Cs}$ is an impedance of each of the variable capacitance elements 4 and 5, and $Z_{Cp}$ is the impedance of the variable capacitance element 3. Moreover, $J=\sqrt{-1}$ and $\omega=2\pi f$ (where f is a used operation frequency).

FIG. 3 shows a state in which the input impedance Za of the helical antenna elements 1 and 2 is transformed into the input impedance in equal to the characteristic impedance $Z_0$ of the coaxial cable 7 of the feeder line, based on the above-mentioned Equation (1). As described with reference to FIGS. 25A and 25B, the input impedance Za has its inductive reactance component increasing as the antenna apparatus approaches the human body. Therefore, the impedance matching state changes depending on the distance D. The impedance matching operation by the balanced to unbalanced transformer 6 and the impedance matching circuit 9 will be described taking the case where the distance D=5 cm as an example.

Referring to FIG. 3, the input impedance Za when D=5 cm is first moved on an equi-conductance circle 301 from a characteristic point 401 to a characteristic point 402 on the locus of a constant resistance circle 302 of a resistance value of 200Ω by the variable capacitance element 3 of the capacitance value Cp. Next, the characteristic point of impedance is moved on the locus of the constant resistance circle 302 of 200Ω from the characteristic point 402 to a characteristic point 403 (intersection of the constant resistance circle 302 of 200Ω and the horizontal axis) which indicates the impedance value of a pure resistance of 200Ω without reactance by the variable capacitance elements 4 and 5 of the capacitance value Cs. Further, regarding the impedance, since the impedance is made to be a quarter of an original value by the balanced to unbalanced transformer 6 constructed of a balun, the input impedance Zin of the helical antenna apparatus finally becomes the characteristic impedance $Z_0$ (normally 50Ω) of the coaxial cable 7 of the transmission line.

Although the above-mentioned example has been described in the case where D=5 cm, it is possible to transform the input impedance Za of the helical antenna elements 1 and 2 into the characteristic impedance $Z_0$=Zin of the coaxial cable 7 of the transmission line quite similarly even in the case of another distance D between the antenna and the human body. For example, if the capacitance value Cp of the variable capacitance element 3 is made to be smaller when D=2 cm than when D=5 cm, then the input impedance can be moved onto the locus of the constant resistance circle 302 of 200Ω and further transformed to the center of the Smith chart of FIG. 3 by the variable capacitance elements 4 and 5 of the capacitance value Cs and the balanced to unbalanced transformer 6 of the balun.

Table 1 shows calculation results of combinations of the capacitance value Cp and the capacitance value Cs with regard to various values of the distance D according to the above-mentioned Equations (1) to (3).

TABLE 1

| Distance D(cm) | Input Impedance Za(Ω) | Capacitance Value Cp(pF) | Capacitance Value Cs(pF) |
|---|---|---|---|
| Free Space | 6.2 + j32 | 32 | ∞ |
| 20 | 4.8 + j43.8 | 28 | 20 |
| 10 | 4.8 + j44.5 | 21 | 10 |
| 5 | 7.6 + j83.7 | 10.5 | 5.4 |
| 2 | 18.3 + j222.1 | 3.4 | 2.9 |

Figure 23:
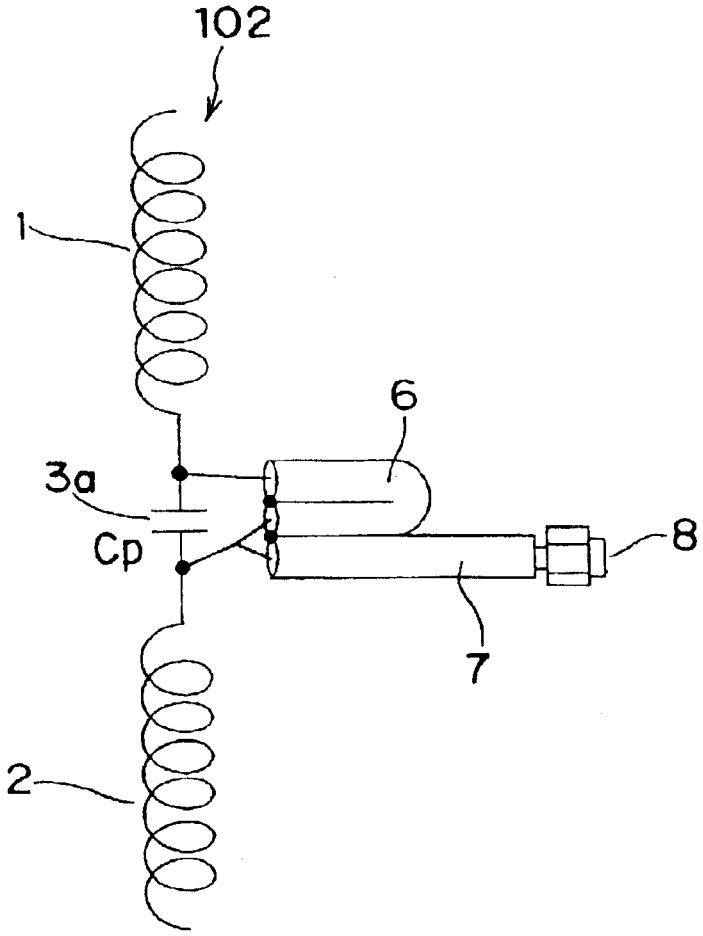
Fig.23 PRIOR ART
FIG. 23 is a circuit diagram showing an equivalent circuit of a helical antenna apparatus for use in the portable radio transceiver 101 for business use of FIG. 22.

In the case of free space in Table 1, the capacitance value Cs=∞, and this corresponds to the prior art helical antenna apparatus 102 (See FIG. 23) which does not have the capacitance value Cs. As is apparent from the transformation mechanism of FIG. 2, in the prior art helical antenna apparatus 102 that does not have the capacitance value Cs, it is impossible to move the input impedance Za to the center of the Smith chart with respect to an arbitrary distance D between the antenna and the human body. However, as is apparent from Table 1, in the helical antenna apparatus of the present preferred embodiment, the input impedance Za of the helical antenna apparatus can be matched with the characteristic impedance $Z_0$=Zin of the coaxial cable 7 of the feeder line by the cooperation of the variable capacitance element 3 of the capacitance value Cp and the variable capacitance elements 4 and 5 of the capacitance value Cs, no matter how the distance D between the antenna and the human body is changed.

Figure 4A:
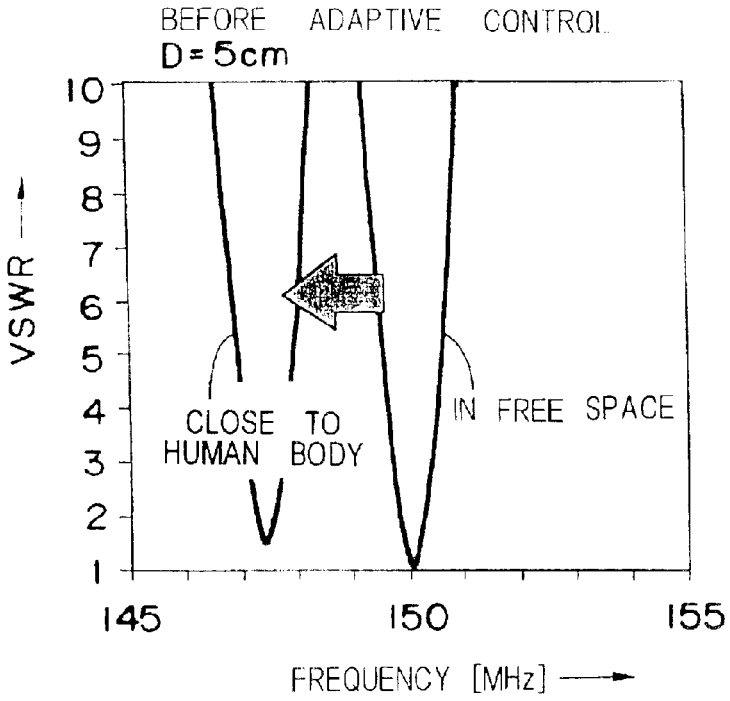
FIG. 4A is a graph showing a frequency characteristic of a voltage standing wave ratio (VSWR) before adaptive control of the helical antenna apparatus of FIG. 1.
Figure 4B:
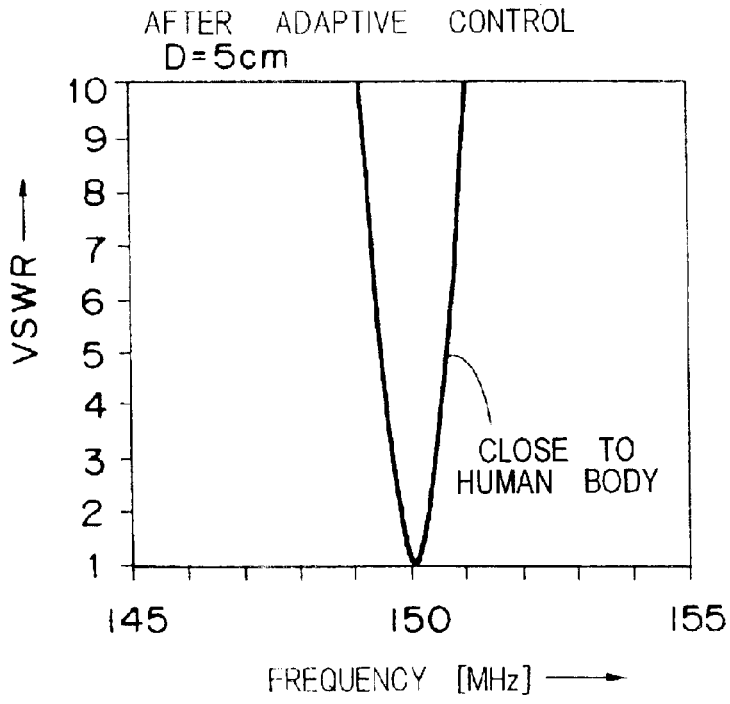
FIG. 4B is a graph showing a frequency characteristic of the voltage standing wave ratio (VSWR) after adaptive control of the helical antenna apparatus of FIG. 1.

FIG. 4A is a graph showing a frequency characteristic of the voltage standing wave ratio (VSWR) before adaptive control of the helical antenna apparatus of FIG. 1, and FIG. 4B is a graph showing a frequency characteristic of the voltage standing wave ratio (VSWR) after adaptive control of the helical antenna apparatus of FIG. 1. That is, FIGS. 4A and 4B show states in which the impedance matching state is maintained by executing the adaptive control with the capacitance value Cp and the capacitance value Cs changed.

In this case, FIG. 4A shows calculation values when the distance D between the antenna and the human body is set to 5 cm with both of the capacitance value Cp and the capacitance value Cs made constant (Cp=32 pF, and Cs=60 pF) in the helical antenna apparatus in the impedance matching state in free space (150 MHz). As is apparent from FIG. 4A, an extremely good impedance matching state is obtained in free space, whereas the resonance frequency is significantly reduced when a human body is located so as to be close to the apparatus, and the impedance matching state at 150 MHz is degraded. On the other hand, FIG. 4B shows a characteristic when the impedance matching state is achieved again at 150 MHz when the adaptive control is executed by changing the capacitance value Cp and the capacitance value Cs (Cp=10.5 pF and Cs=5.4 pF; See Table 1) when a human body is located so as to be close to the apparatus as shown in FIG. 4A. As is apparent from FIG. 4B, a satisfactory impedance matching state is shown at 150 MHz. As described above, the helical antenna apparatus of the present preferred embodiment can operate so as to maintain the impedance matching state when a human body is located so as to be close to the apparatus.

As is apparent from FIGS. 4A and 4B, the variable capacitance element 3 of the capacitance value Cp and the variable capacitance elements 4 and 5 of the capacitance value Cs play the role of equivalently changing the resonance frequency of the helical antenna apparatus. Therefore, by setting these capacitance values Cp and Cs so as to appropriately selectively change them, the resonance frequency of the helical antenna apparatus in free space can be changed.

Figure 5:
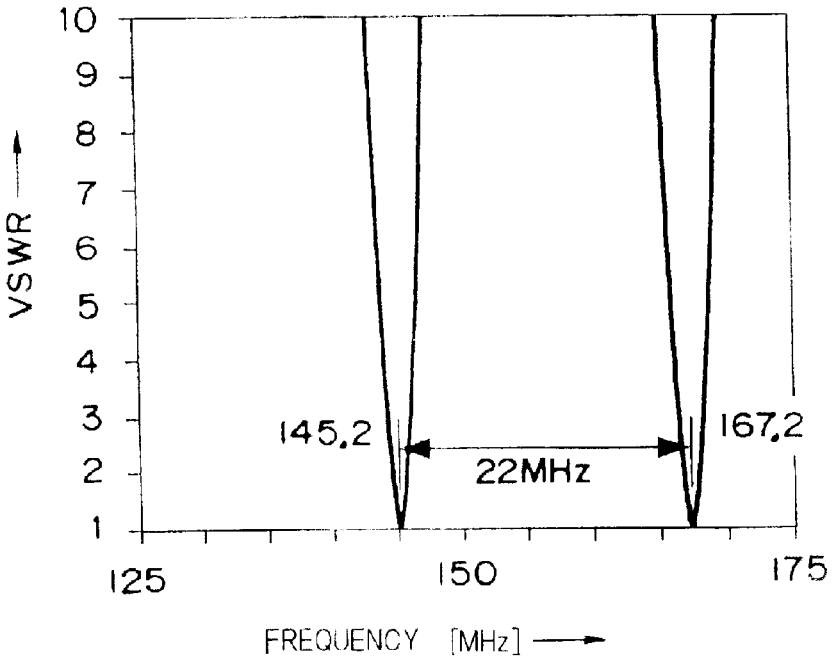
FIG. 5 is a graph showing a frequency characteristic and the frequency range of the voltage standing wave ratio (VSWR) after adaptive control in the helical antenna apparatus of FIG. 1.

FIG. 5 is a graph showing a frequency characteristic and the frequency range of the voltage standing wave ratio (VSWR) after adaptive control of the helical antenna apparatus of FIG. 1, and FIG. 5 shows experimental results when the capacitance value Cp and the capacitance value Cs are changed in free space. As is apparent from FIG. 5, a satisfactory impedance matching state can be maintained over the bandwidth of 22 MHz ranging from 145 MHz to 167 MHz.

Figure 24:
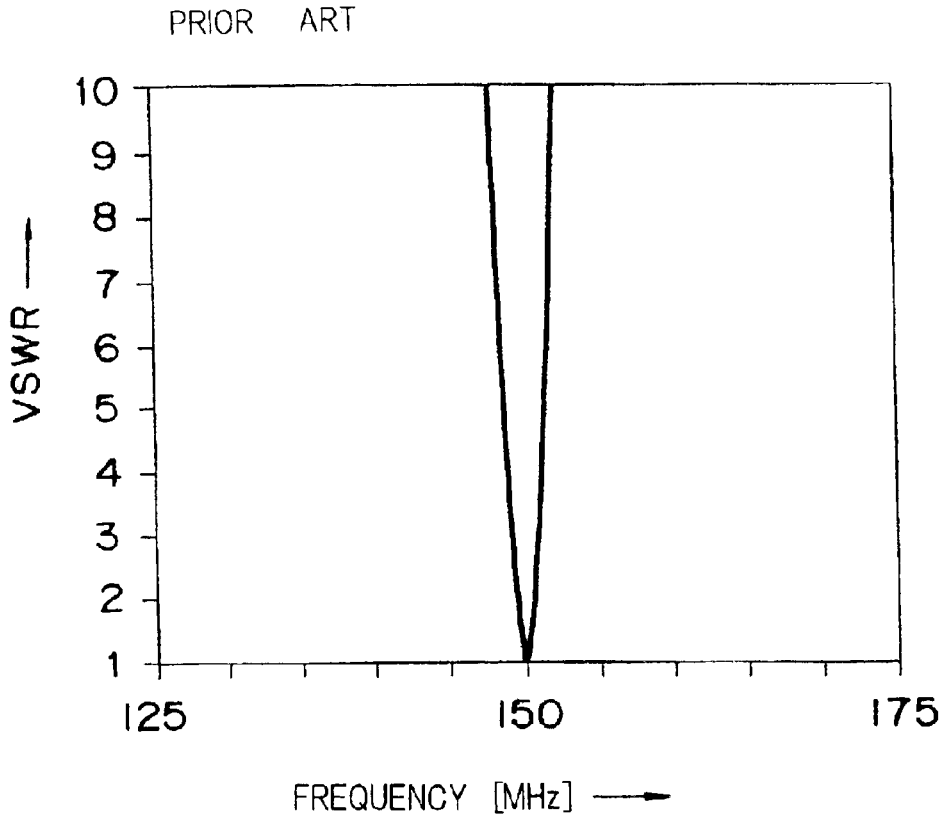
FIG. 24 is a graph showing a frequency characteristic of the voltage standing wave ratio (VSWR) in the helical antenna apparatus 102 of FIG. 23.

It has been described that the impedance characteristic has had a narrow range as one of the problems of the helical antenna apparatus 102 with reference to FIG. 24. However, as is apparent from FIG. 5, according to the helical antenna apparatus of the present preferred embodiment, an extremely wide-range impedance matching characteristic can be equivalently obtained by appropriately selectively changing the capacitance value Cp and the capacitance value Cs. With this arrangement, in contrast to a plurality of helical antenna elements for switchover use that have been required to satisfy the impedance characteristic of the desired bandwidth, it is enabled to satisfy the impedance characteristic in the use frequency band by an extremely small number of, or one or two helical antenna elements.

As described above, the present preferred embodiment, which is provided with the variable capacitance elements 4 and 5 in addition to the variable capacitance element 3, is therefore able to use the helical antenna apparatus in a wide band and reduce the power loss due to impedance mismatching with the setting of the impedance matching state when the antenna apparatus is located so as to be close to a human body.

Although the above-mentioned preferred embodiment has been described taking the helical antenna apparatus for use in the portable radio transceiver for business use operating in the 150 MHz band as an example, the operation mechanism is similar also in another frequency band. For example, the helical antenna apparatus of the present preferred embodiment satisfactorily operates even in the case of a helical antenna apparatus for a 900 MHz band portable telephone.

Although the U-shaped balun is employed as the balanced to unbalanced transformer 6 for impedance matching in the above-mentioned preferred embodiment, it is also acceptable to employ a balanced to unbalanced transformer (for example, a spectacle-shaped balun using ferrite) other than the U-shaped balun. Further, if it is not necessary to reduce the impedance value to a quarter of the original value, a balun (such as sleeve balun or the like) of which the impedance transformation ratio is 1:1 can be also employed.

Figure 20:
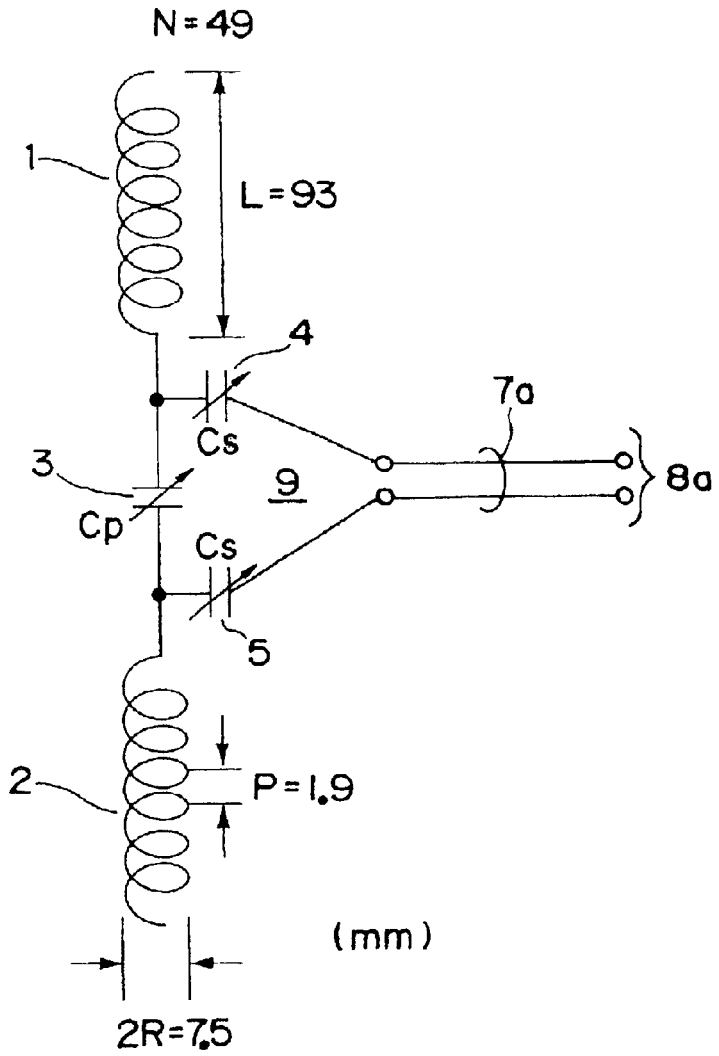
FIG. 20 is a circuit diagram showing a construction of a helical antenna apparatus according to a modified preferred embodiment of the first preferred embodiment.

Further, it is acceptable to employ a balanced type cable 7*a* of, for example, a ribbon type feeder as a feeder line in place of the balanced to unbalanced transformer 6 and the coaxial cable 7 as shown in the modified preferred embodiment of FIG. 20. In this case, the input port 8*a* of the balanced type cable 7*a* serves as a feeding port.

Second Preferred Embodiment

Figure 6:
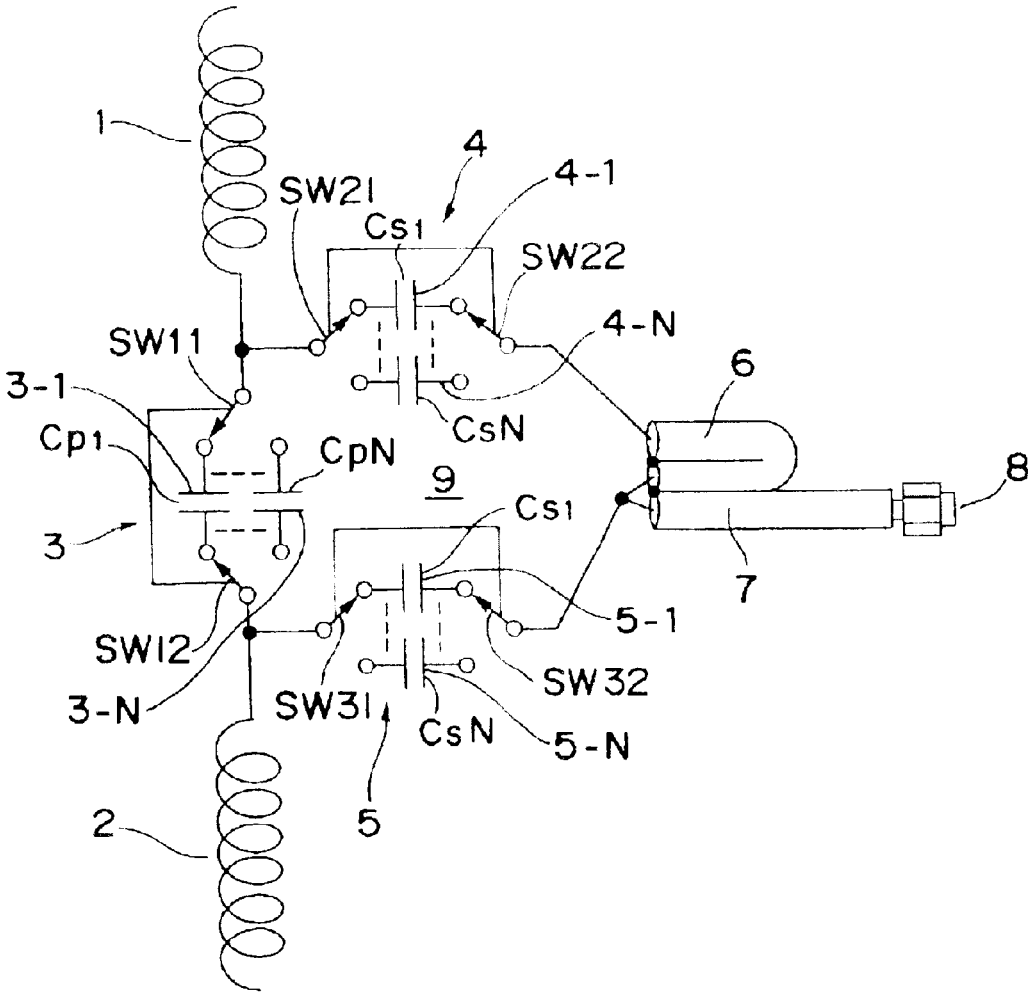
FIG. 6 is a circuit diagram showing a construction of a helical antenna apparatus according to a second preferred embodiment of the present invention.

FIG. 6 is a circuit diagram showing a construction of a helical antenna apparatus according to the second preferred embodiment of the present invention. The helical antenna apparatus of this second preferred embodiment is different from the first preferred embodiment as follows:

(a) The variable capacitance element 3 is constructed of a plurality of capacitors 3-1 to 3-N that have mutually different capacitance values $Cp_1$ to $Cp_N$, respectively, and switches SW11 and SW12 that selectively switch among both ends of the capacitors 3-1 to 3-N in an interlocked manner.

(b) The variable capacitance element 4 is constructed of a plurality of capacitors 4-1 to 4-N that have mutually different capacitance values $Cs_1$ to $Cs_N$, respectively, and switches SW21 and SW22 that selectively switch among both ends of the capacitors 4-1 to 4-N in an interlocked manner.

(c) The variable capacitance element 5 is constructed of a plurality of capacitors 5-1 to 5-N that have mutually different capacitance values $Cs_1$ to $Cs_N$, respectively, and switches SW31 and SW32 that selectively switch among both ends of the capacitors 5-1 to 5-N in an interlocked manner.

In this case, the switchover between the switches SW21 and SW22 and the switchover between the switches SW31 and SW32 should be preferably operated selectively in an interlocked manner, so that similar capacitance values are provided.

In the second preferred embodiment constructed as above, by selecting an appropriate combination of the capacitance value Cp of the variable capacitance element 3 and the capacitance value Cs of the variable capacitance elements 4 and 5, so that a satisfactory impedance matching state is maintained when the helical antenna elements 1 and 2 are located so as to be close to a human body, namely, by setting appropriate capacitance values Cp and Cs for the variable capacitance elements 3, 4 and 5 with the switches SW11, SW12, SW21, SW22, SW31 and SW32 in the construction of FIG. 6, in a manner similar to that of the first preferred embodiment as described with reference to Table 1, a satisfactory impedance matching state can be maintained.

In the above-mentioned preferred embodiment, the switches SW11, SW12, SW21, SW22, SW31 and SW32 may be mechanical switches or electronic switches that employ semiconductor transistors, semiconductor diodes or the like. Moreover, it is possible to achieve a wide-band characteristic in free space with the resonance frequency changed as shown in FIG. 5 by selecting an appropriate combination of the capacitance value Cp of the variable capacitance element 3 and the capacitance value Cs of the variable capacitance elements 4 and 5.

Third Preferred Embodiment

Figure 7:
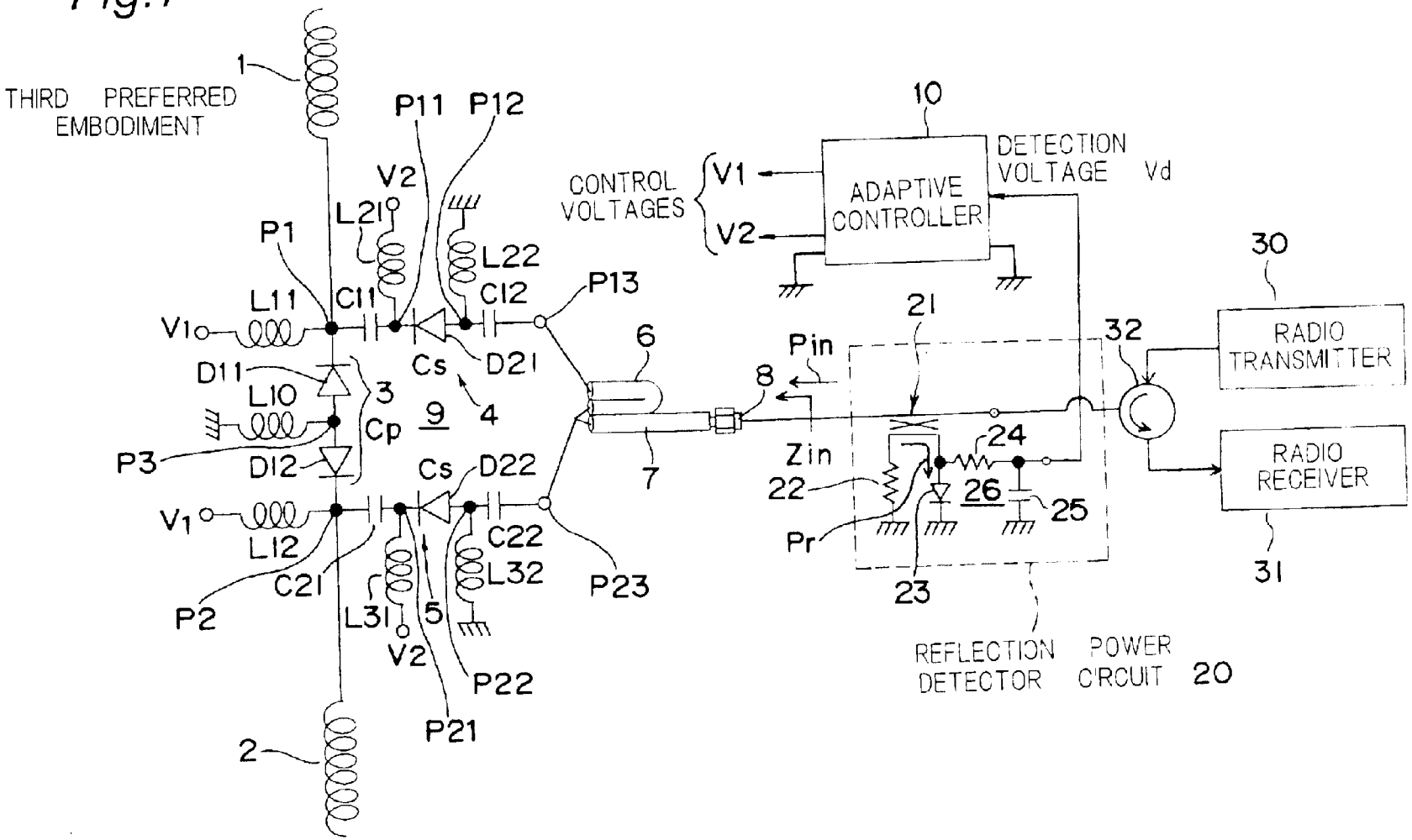
FIG. 7 is a circuit diagram showing a construction of a helical antenna apparatus according to a third preferred embodiment of the present invention.

FIG. 7 is a circuit diagram showing a construction of a helical antenna apparatus according to the third preferred embodiment of the present invention. The helical antenna apparatus of this third preferred embodiment is different from the first preferred embodiment as follows:

(a) The variable capacitance element 3 is constructed of two variable capacitance diodes D11 and D12 (the capacitance value Cp is provided by the two variable capacitance diodes D11 and D12) which are connected in series and the anodes of which are directly connected to each other.

(b) The variable capacitance element 4 is constructed of one variable capacitance diode D21.

(c) The variable capacitance element 5 is constructed of one variable capacitance diode D22.

(d) There is further provided a reflection power detector circuit 20, which is inserted between a circulator 32, to which a radio transmitter 30 and a radio receiver 31 are connected, and an input connector 8, and which detects a reflection power as a detection voltage Vd of a reflection signal.

(e) There is further provided an adaptive controller 10, which calculates and sets reverse bias control voltages (hereinafter referred to as control voltages) V1 and V2 to be applied to the variable capacitance elements 3, 4 and 5 for executing adaptive control, so that the input impedance Zin when the helical antenna elements 1 and 2 are seen from the input connector 8 coincided with the input impedance Za of the helical antenna elements 1 and 2 even when a human body is located so as to be close to the helical antenna elements 1 and 2, based on the detection voltage Vd from the reflection power detector circuit 20. It is assumed that the characteristic impedance of the coaxial cables 6 and 7 is $Z_0$. The above-mentioned points of difference will be described in detail below.

Referring to FIG. 7, one end of the helical antenna element 1 is connected to one end of the helical antenna element 2 via a connection point P1, the cathode and the anode of the variable capacitance diode D11, the cathode and the anode of the variable capacitance diode D12, and a connection point P2 . The connection point P1 is connected to an output terminal of the control voltage V1 of the adaptive controller 10 via an inductor L11 for high-frequency blocking and connected to a central conductor located at one end of a balanced to unbalanced transformer 6 via a capacitor C11 for DC voltage blocking, a connection point P11, the cathode and the anode of the variable capacitance diode D21, a connection point P12, a capacitor C12 for DC voltage blocking and a connection point P13. The connection point P2 is connected to the output terminal of the control voltage V1 of the adaptive controller 10 via an inductor L12 for high frequency blocking and connected to the central conductor located at the other end of the balanced to unbalanced transformer 6 and the central conductor of the coaxial cable 7 via a capacitor C21 for DC voltage blocking, a connection point P21, the cathode and the anode of the variable capacitance diode D22, a connection point P22, a capacitor C22 for DC voltage blocking and a connection point P23. The connection point P3 is grounded via an inductor L10 for high frequency blocking.

Further, the connection point P11 is connected to an output terminal of the control voltage V2 of the adaptive controller 10 via an inductor L21 for high frequency blocking, and the connection point P12 is grounded via an inductor L22 for high frequency blocking. The connection point P21 is connected to the output terminal of the control voltage V2 of the adaptive controller 10 via an inductor L31 for high frequency blocking, and the connection point P22 is grounded via an inductor L32 for high frequency blocking. Therefore, the control voltage V1 outputted from the adaptive controller 10 is applied across both ends of the variable capacitance diodes D11 and D12, and the control voltage V2 outputted from the adaptive controller 10 is applied across both ends of the variable capacitance diodes D21 and D22. With this arrangement, by controlling the control voltages V1 and V2, the respective capacitance values of the variable capacitance diodes D11, D12, D21 and D22, i.e., the capacitance value Cp of the variable capacitance element 3 and the capacitance value Cs of the variable capacitance elements 4 and 5 can be controlled. These capacitance values Cp and Cs can be expressed by, for example, the following Equations (4) and (5):

$$Cp=C_0/\{(1-V1/\phi)^m\} \quad (4)$$

and $$Cs=C_0/\{(1-V2/\phi)^m\} \quad (5)$$

where $C_0$ is a basic capacitance constant of capacitance, $\phi$ is a scaling factor of voltage, and m is the number of power for determining the characteristic of a capacitance-to-voltage characteristic.

The radio transmitter 30 of FIG. 7 modulates a carrier signal of a radio signal according to an inputted transmission signal of, for example, an audio signal by using a predetermined modulation system, amplifies the electric power of the modulated signal, and then, outputs the resulting signal to the reflection power detector circuit 20 via the circulator 32.

In the reflection power detector circuit 20 of FIG. 7, a four-terminal directional coupler 21 is inserted between the circulator 32 to which the radio transmitter 30 and the radio receiver 31 are connected and the input connector 8. The transmission signal from the radio transmitter 30 is transmitted to the helical antenna elements 1 and 2 via the circulator 32 and the input connector 8, and a part of the signal is branched and terminated at a non-reflective terminator 22. At this time, the reflection signal of the transmission signal reflected from the helical antenna elements 1 and 2 is detected by a detection diode 23, and then, is low-pass filtered by a low-pass filter 26 constructed of a resistor 24 and a capacitor 25. A detection voltage Vd that has undergone the low-pass filtering comes to have a value proportional to the square root of the electric power of the reflection signal and is outputted to the adaptive controller 10.

Assuming that a transmission power from the radio transmitter 30 to the helical antenna elements 1 and 2 is Pin, and the reflection coefficient is $\Gamma(=(Zin-Z_0)/(Zin+Z_0))$ at the output terminal located on the input connector 8 side of the reflection power detector circuit 20 of FIG. 7, then a reflection power Pr detected by the reflection power detector circuit 20 is expressed by the following Equation (6), and the detection voltage Vd is expressed by the following Equation (7):

$$Pr=|\Gamma|^2 Pin \quad (6),$$

and $$Vd=K\sqrt{Pr} \quad (7).$$

It is to be noted that K is a constant determined by the detection diode 23 or the like. In this case, as shown in the Equation (7), the detection voltage Vd is proportional to the square root of the reflection power Pr.

Further, during the reception time of the antenna apparatus, the received signal received by the helical antenna elements 1 and 2 is inputted to the radio receiver 31 via the reflection power detector circuit 20 and the circulator 32, and thereafter, the received signal is subjected to the processing of low-frequency conversion, demodulation and so on. A radio communication apparatus can be constructed of the circuit from the helical antenna elements 1 and 2 to the radio transmitter 30 and the radio receiver 31 constructed as above.

In the second preferred embodiment, the number of capacitors 3-1 to 3-N, 4-1 to 4-N and 5-1 to 5-N, which can be selected by the switches SW11 to SW32 is limited to finite, and accordingly, there are limitations on the number of impedance matching states that can be achieved. However, if the variable capacitance diodes D11 to D22 are employed as shown in FIG. 7, it is enabled to set an arbitrary capacitance value by the control voltages applied to the variable capacitance diodes D11 to D22. Therefore, it is theoretically possible to select an infinite number of impedance matching states. Therefore, no matter what distance is between the antenna and the human body, it is possible to maintain the impedance matching state by the electronic operation of applying the control voltages.

The reflection power detector circuit 20 and the adaptive controller 10 in FIG. 7 constitute a servo system, in which the detection voltage Vd is used as an estimation function. The adaptive controller 10 is a control circuit for applying the control voltages V1 and V2 to the variable capacitance diodes D11 to D22 , so that the detection voltage Vd is minimized. Therefore, a guiding or leading principle (or golden rule) for minimizing the estimation function is important. As a guiding principle, there can be used the least square method (LMS algorithm) and the recursive least square method (RLS algorithm), which are normally often used. When an algorithm as described above is used, a control circuit of a calculation processing type including a microcomputer (MPU, DSP or CPU) can be utilized for the adaptive controller 10.

Figure 21:
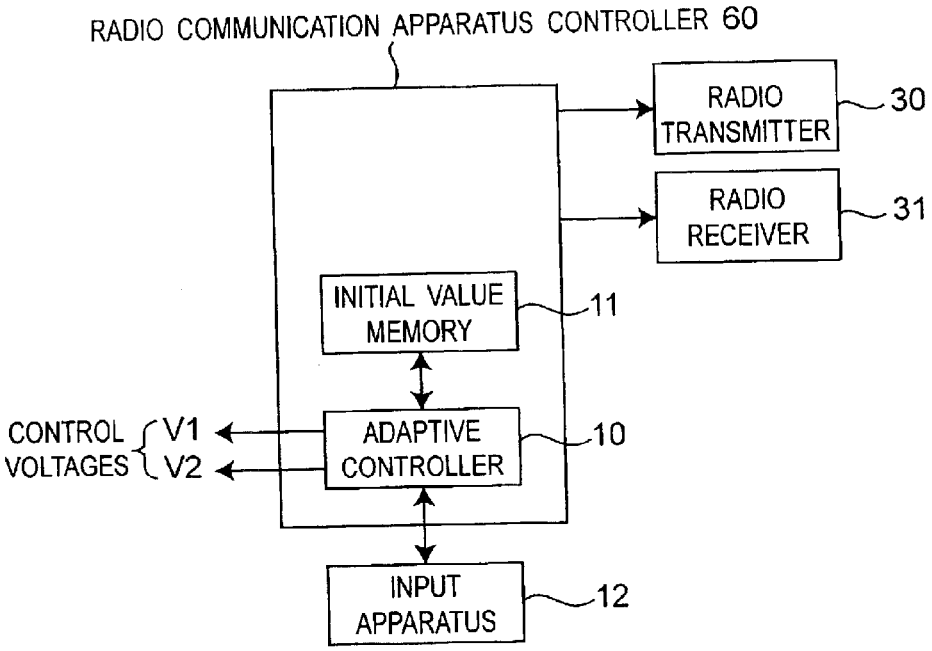
FIG. 21 is a block diagram showing a construction of a radio communication apparatus controller 60 according to a modified preferred embodiment of the third preferred embodiment.
Figure 22:
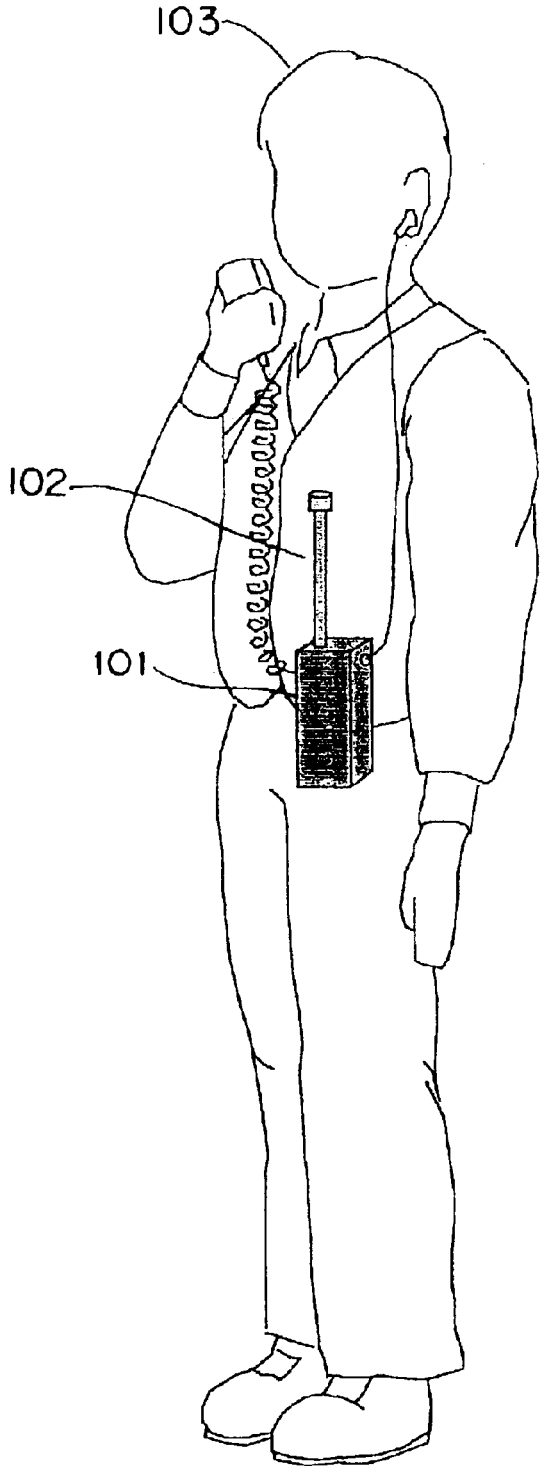
Fig.22 PRIOR ART
FIG. 22 is a perspective view showing one example of a situation in which a prior art portable radio transceiver 101 for business use is used.

Moreover, as shown in FIG. 21, the adaptive controller 10 may be provided inside of a radio communication apparatus controller 60 that controls the operation of the radio transmitter 30 and the radio receiver 31. That is, by constituting the adaptive controller 10 and the radio communication apparatus controller 60 of an identical microcomputer (MPU, DSP or CPU), the number of components can be reduced. It is to be noted that the construction of FIG. 7 in which the reflected power detector 20 and the adaptive controller 10 are added and the construction of FIG. 21 can be also applied to the other preferred embodiments.

Figure 8:
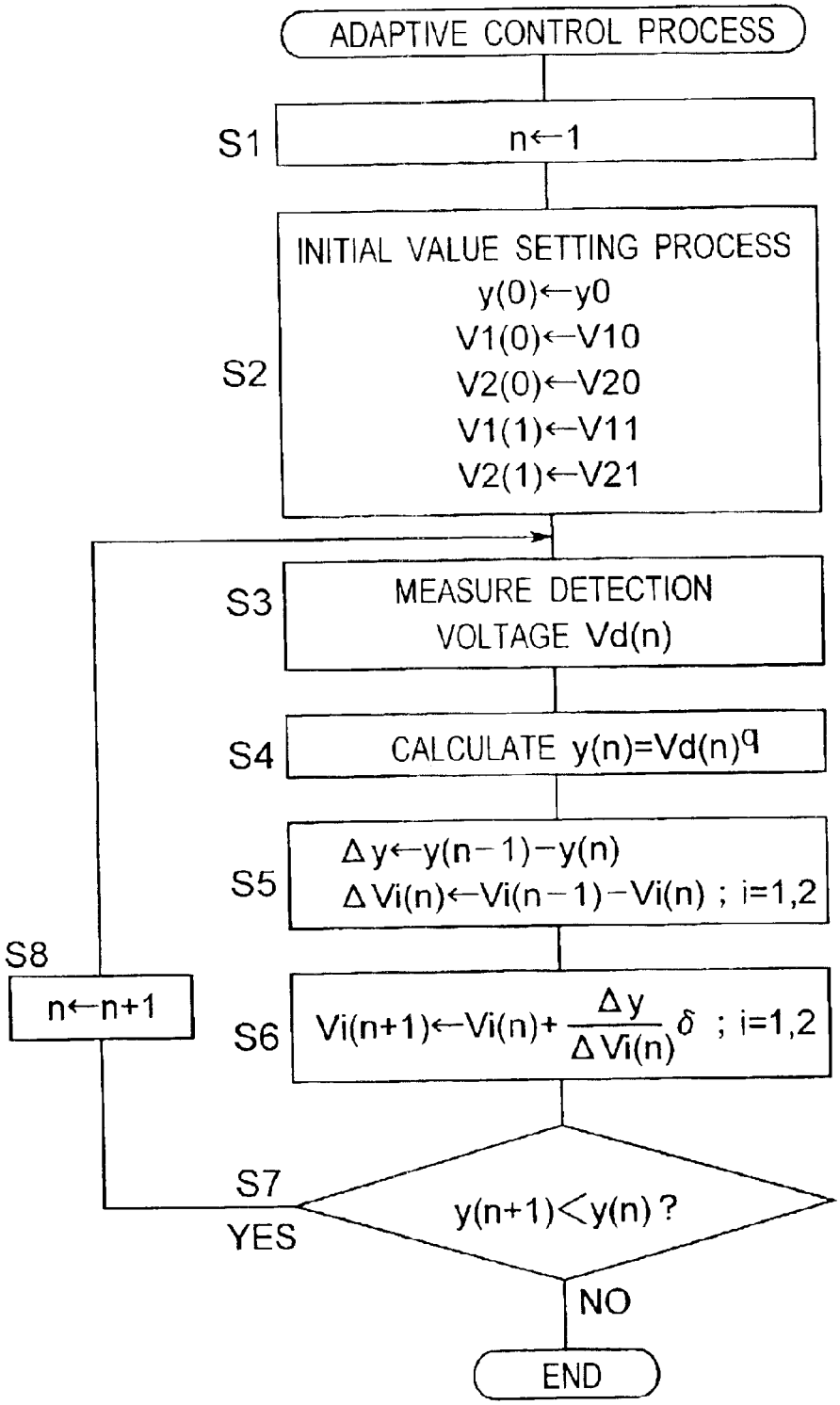
FIG. 8 is a flowchart showing an adaptive control processing executed by an adaptive controller 10 of FIG. 7.

FIG. 8 is a flowchart showing an adaptive control processing executed by the adaptive controller 10 of FIG. 7. First of all, the basic principle of a method for minimizing the detection voltage Vd through this adaptive control processing will be described. The detection voltage Vd, which is changed by the control voltages V1 and V2, is therefore expressed by the following Equation if the detection voltage is a function of the control voltages:

$$Vd=f(V1,V2) \quad (8),$$

where the task of minimizing the detection voltage Vd is equivalent to obtaining the two variables V1 and V2 such that the function f(V1, V2) is minimized.

For this purpose, it is proper to obtain the direction in which the inclination is maximized by subjecting the function f to partial differential with respect to the variables V1 and V2 for advancement in the direction little by little. That is, if the partial differential is replaced by a minute change, then the following Equation is obtained:

$$V_1(n+1) = V_1(n) + \frac{\Delta Vd}{\Delta V_1(n)}\delta \quad (9)$$

$$V_2(n+1) = V_2(n) + \frac{\Delta Vd}{\Delta V_2(n)}\delta \quad (10)$$

where Vi(n) and Vi(n+1) (i=1, 2) represent the control voltages of the n-th sample and the (n+1)-th sample, and δ represents a step interval of updating the sample, the interval being predetermined by the velocity of convergence and the residual after convergence. The above-mentioned Equations (9) and (10) express that, if the (n+1)-th voltage value is obtained from the n-th voltage value of the control voltage Vi and this operation is repeated for the successive obtainment of the subsequent values, then the value will finally reach the minimum value of the detection voltage Vd.

In the above-mentioned preferred embodiment, the adaptive control processing is executed on the assumption that the task of minimizing the detection voltage Vd is equivalent to obtaining the two variables V1 and V2 such that the function f(V1, V2) is minimized. Instead of this, it is preferable to execute the adaptive control processing by using the steepest descent method so as to minimize the estimation function y of the following Equation:

$$y=Vd^q \quad (11),$$

where q is the number of power for determining the estimation function. The number of power q is experimentally determined, based on the simulation results described later, so that the estimation function y has one minimum value and sharply converged onto the minimum value.

Next, the adaptive control processing of FIG. 8 executed by the adaptive controller 10 will be described. First of all, a step parameter n is initialized to one in step S1, and the initial value setting processing is executed in step S2 as follows.

(1) An initial value y0 of a predetermined estimation function is substituted into an estimation function value y(0).

(2) An initial value V10 of a predetermined first control voltage is substituted into a detection voltage V1(0).

(3) An initial value V20 of a predetermined second control voltage is substituted into a detection voltage V2(0).

(4) A predetermined first control voltage V11 in the first step is substituted into a detection voltage V1(1), and is applied to the variable capacitance diodes D11 and D12.

(5) A predetermined second control voltage V21 in the first step is substituted into a detection voltage V2(1), and is applied to the variable capacitance diodes D21 and D22.

In this state, the detection voltage Vd is measured, and then, the measured detection voltage Vd is substituted into Vd(n) in step S3. Then, the estimation function value y(n) is calculated by using the following Equation in step S4:

$$y(n)=\{Vd(n)\}^q \quad (12).$$

Next, difference values Δy and ΔVi(n) (i=1, 2) are calculated by using the following Equations in step S5:

$$\Delta y \leftarrow y(n-1)-y(n) \quad (13),$$

and $$\Delta Vi(n) \leftarrow Vi(n-1)-Vi(n); i=1,2 \quad (14).$$

Further, in step S6, the control voltages V1(n+1) and V2(n+1) in the next step are calculated by using the following Equation, the control voltage V1(n+1) is applied to the variable capacitance diodes D11 and D12, and the control voltage V2(n+1) is applied to the variable capacitance diodes D21 and D22. Then, the estimation function value y(n+1) at this time is calculated by using the Equation (12):

$$Vi(n+1) \leftarrow Vi(n)+\{\Delta y/\Delta Vi(n)\}\delta; i=1,2 \quad (15),$$

where δ is a step interval that updates the sample, and is a value predetermined by the velocity of convergence and the residual after convergence as described hereinabove. Further, it is judged in step S7 whether or not the estimation function value y(n+1)<y(n), representing the non-convergence condition. If the answer is YES in step S8, then this means that the convergence has not yet been achieved, then the step parameter n is incremented by one in step S8, and thereafter, the control flow proceeds to step S3. If the answer is NO in step S7, the adaptive control processing is completed by judging that the convergence has been achieved.

In this control flow, the control voltages V1(n+1) and V2(n+2), which can be adaptively controlled, are applied to the variable capacitance diodes D11 to D22 in step S6 after the convergence. In the helical antenna apparatus, an impedance matching can be achieved by making the input impedance Zin substantially coincide with the input impedance Za of the helical antenna elements 1 and 2.

The preferred embodiment, which is constructed as above, is constructed for the purpose of controlling the impedance change due to the interaction between the human body and the antenna. However, with regard to a servo system function, the preferred embodiment operates so as to minimize the detection voltage Vd that is the estimation function. Therefore, even when the impedance matching state changes as a consequence of the change in the operation frequency of the radio transmitter, the servo system operates so as to provide the best matching state at the operation frequency. That is, the optimum impedance matching state is achieved regardless of the kind of the cause.

In the above-mentioned preferred embodiment, the adaptive control is executed, so that the reflection power is minimized. However, the present invention is allowed to execute the adaptive control by measuring the VSWR or reflection coefficient, so that the measured VSWR or reflection coefficient becomes minimized.

In the above-mentioned preferred embodiment, the control is executed by applying the control voltages V1 and V2 to the variable capacitance diodes. However, the present invention is not limited to this, and the adaptive controller 10 is allowed to control the switching of the switches SW11 to SW32 of the second preferred embodiment of FIG. 6, so that the detection voltage Vd becomes minimized, i.e., the impedance matching state is achieved.

Figure 9:
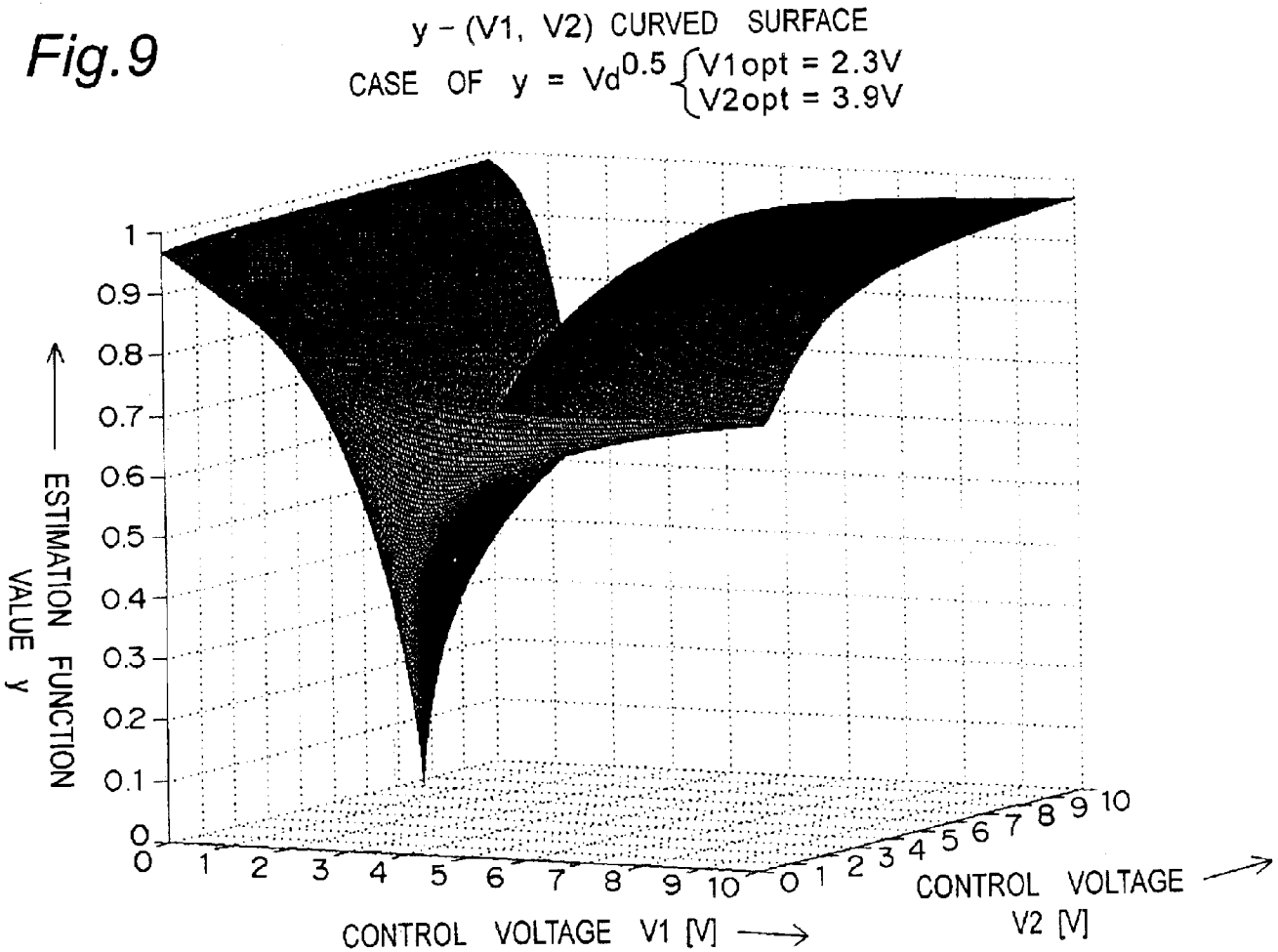
FIG. 9 is a graph showing a curved surface of the relation among a control voltage V1, a control voltage V2 and an estimation function value y when the adaptive control is executed by the adaptive controller 10 using an estimation function $y=Vd^{0.5}$ in a circuit of FIG. 7.
Figure 10:
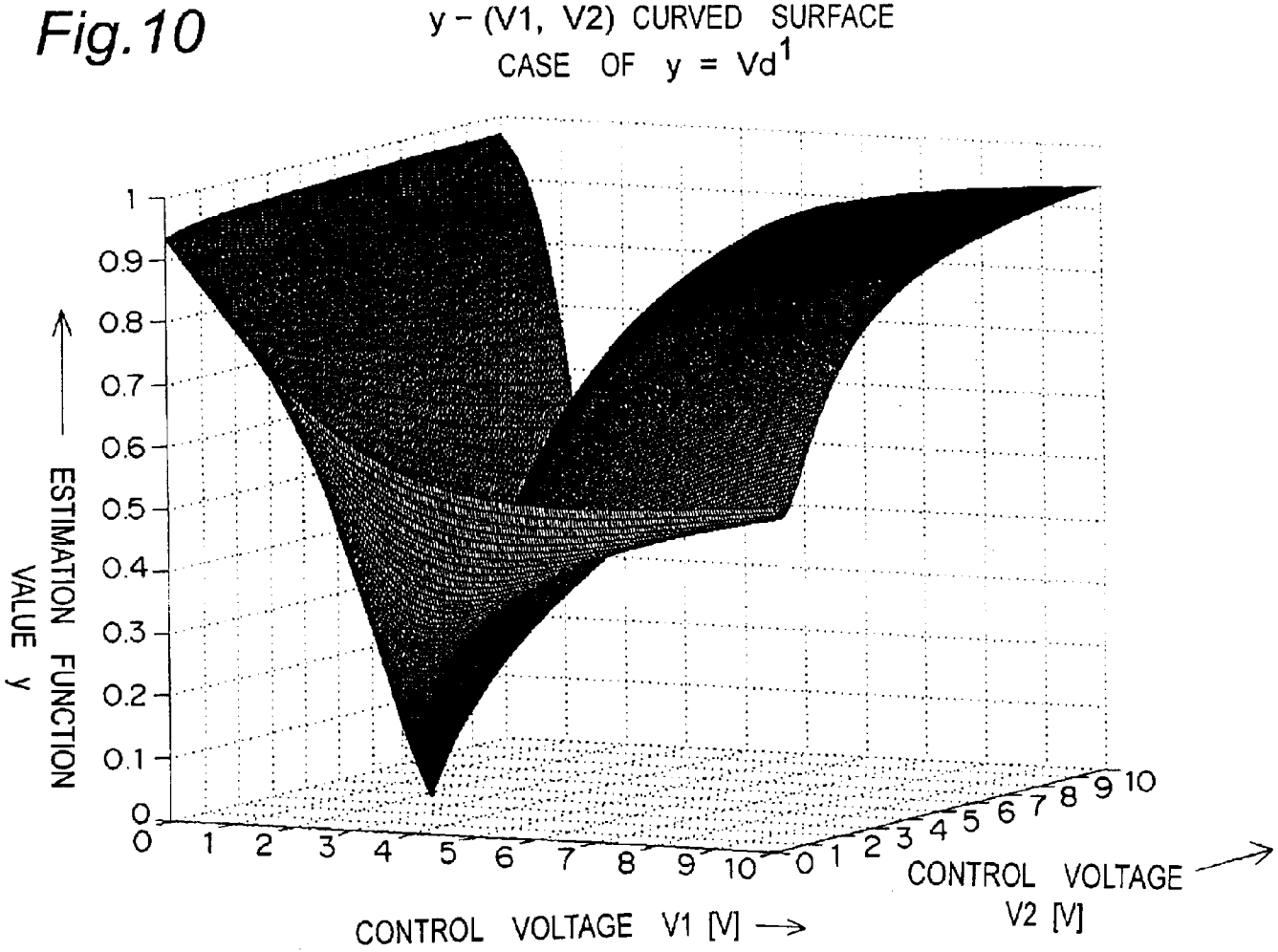
FIG. 10 is a graph showing a curved surface of the relation among the control voltage V1, the control voltage V2 and the estimation function value y when the adaptive control is executed by the adaptive controller 10 using an estimation function $y=Vd^{1}$ in the circuit of FIG. 7.
Figure 11:
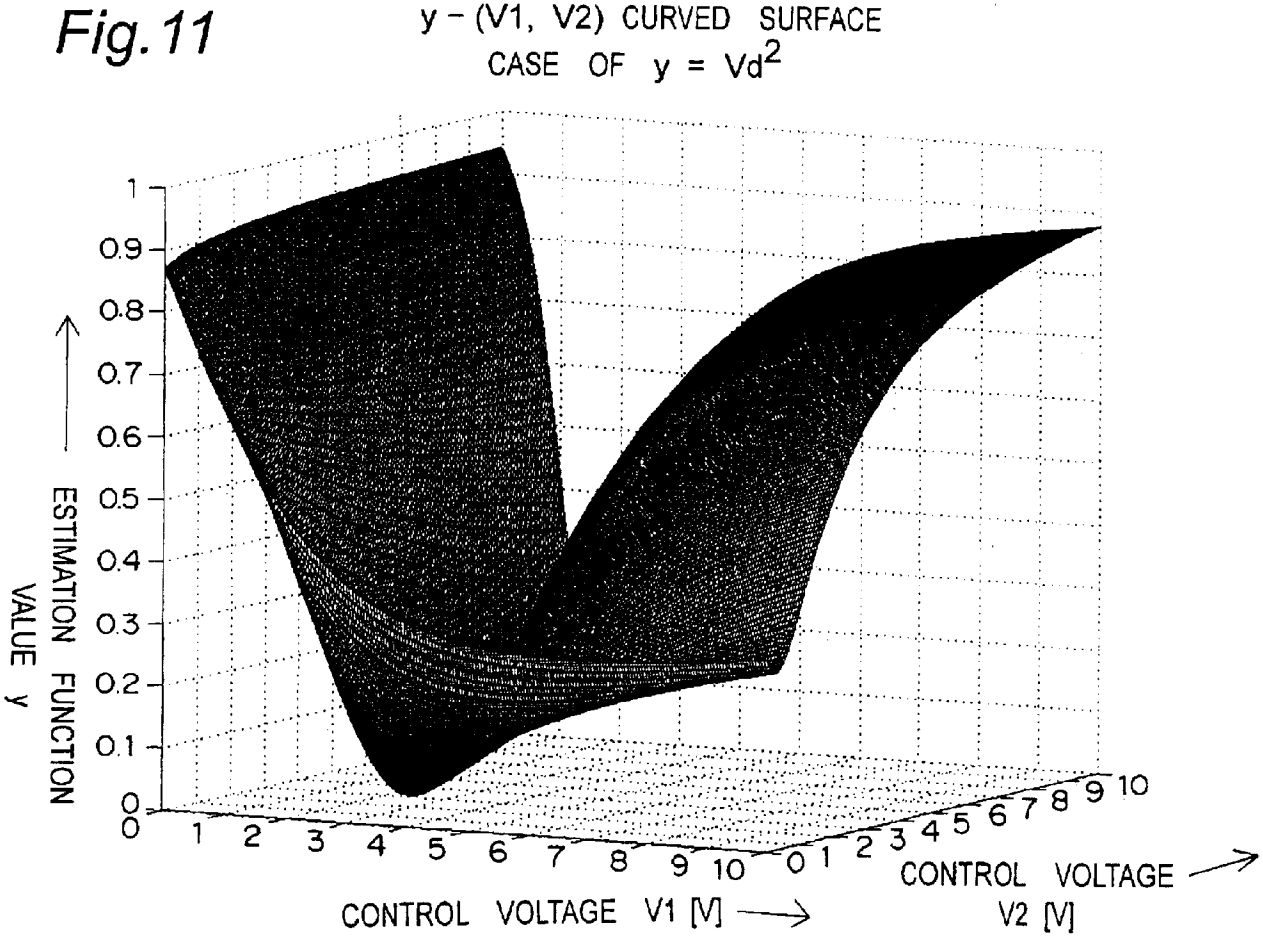
FIG. 11 is a graph showing a curved surface of the relation among the control voltage V1, the control voltage V2 and the estimation function value y when the adaptive control is executed by the adaptive controller 10 using an estimation function $y=Vd^{2}$ in the circuit of FIG. 7.
Figure 12:
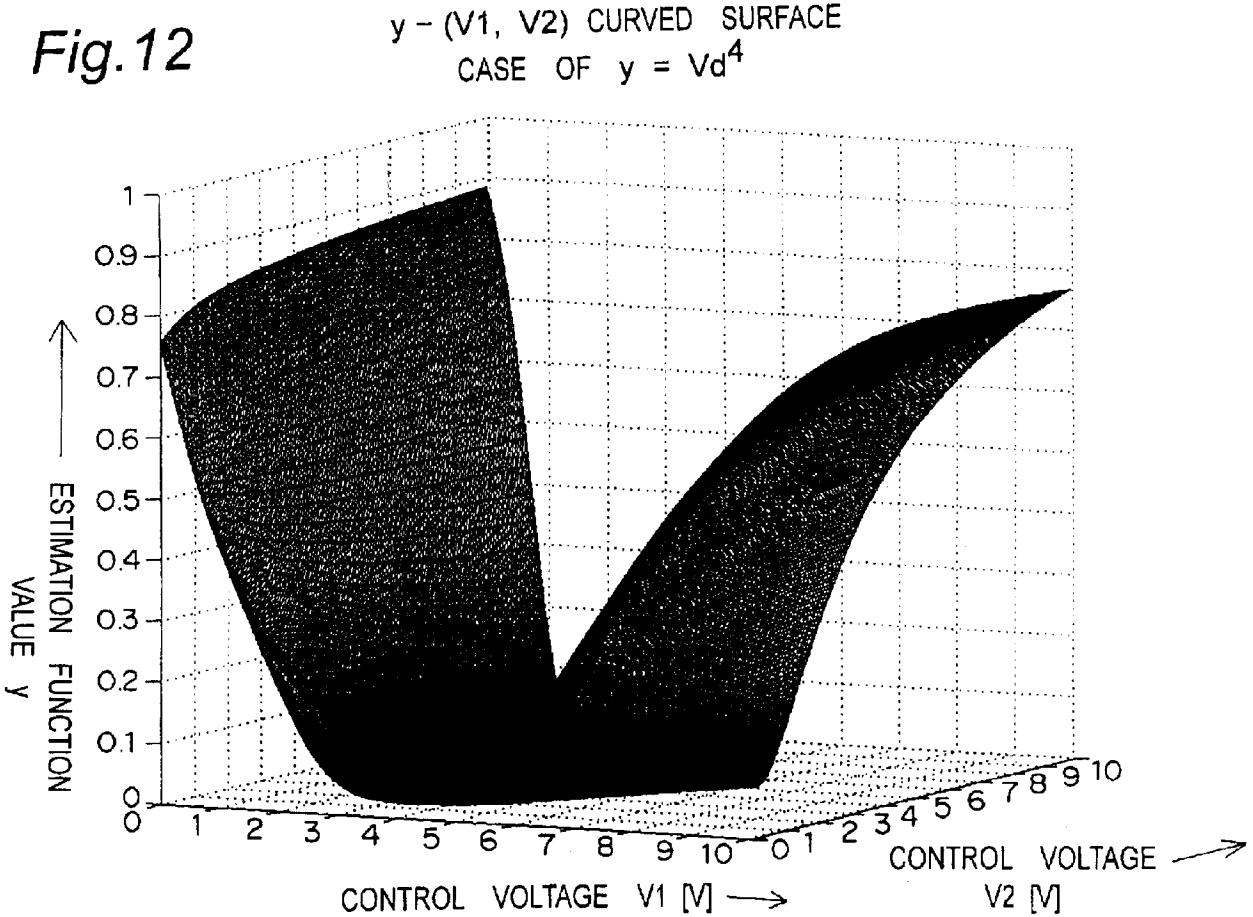
FIG. 12 is a graph showing a curved surface of the relation among the control voltage V1, the control voltage V2 and the estimation function value y when the adaptive control is executed by the adaptive controller 10 using an estimation function $y=Vd^{4}$ in the circuit of FIG. 7.

Further, the simulation results when the number of power q of the estimation function of the Equation (12) is changed will be described below with reference to FIGS. 9 to 12. In this simulation, it is assumed that the effects of the capacitors C11, C12, C21 and C22 and the inductors L10, L11, L12, L21, L22, L31 and L32 which are shown in FIG. 7 are ignored. FIG. 9 shows a graph showing a curved surface of the relation among the estimation function value y and the control voltages V1 and V2 when q=0.5. FIG. 10 shows a similar graph when q=1. FIG. 11 shows a similar graph when q=2. FIG. 12 shows a similar graph when q=4.

As is apparent from FIGS. 9 to 12, it can be understood that the curved surface calculated within the ranges of the control voltages V1 and V2, in particular when q=2 shown in FIG. 11 includes a local minimum point and is smooth throughout the entire regions and differentiable. Therefore, in the present preferred embodiment, the steepest descent method is used as an adaptive control method for optimization. Moreover, according to the simulation conducted by the present inventor, the estimation function becomes most preferable when q=2 in the Equation (12) from the viewpoints of the continuity of the convergence curved surface and the angle of inclination.

Next, the experimental results of the circuit of FIG. 7 will be described below.

Figure 13A:
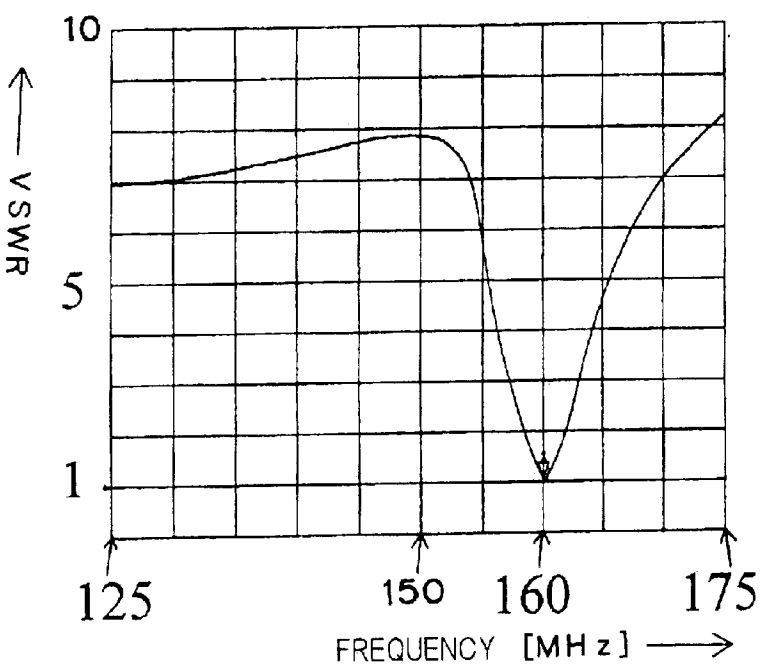
FIG. 13A is a graph showing a frequency characteristic of the voltage standing wave ratio (VSWR) in free space when no human body is located so as to be close to the helical antenna apparatus in the circuit of FIG. 7.
Figure 13B:
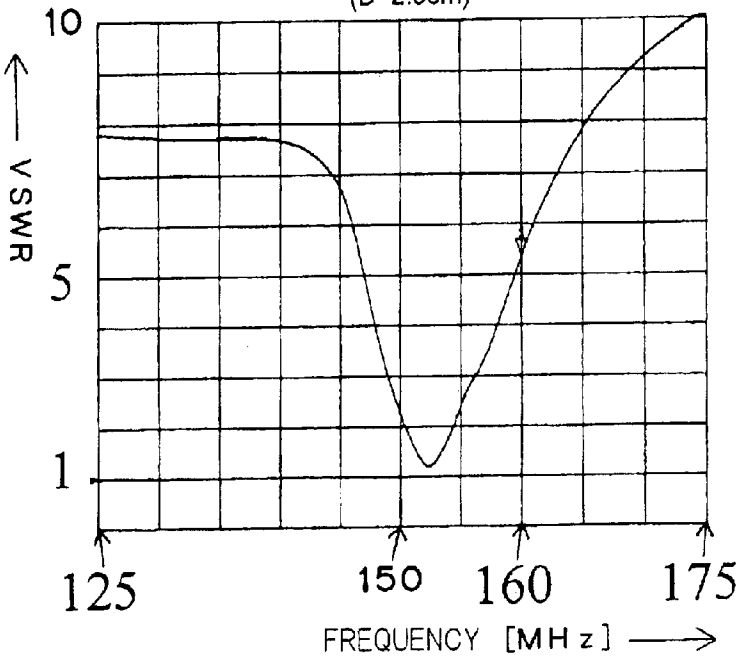
FIG. 13B is a graph showing a frequency characteristic of the voltage standing wave ratio (VSWR) when a human body is located so as to be close to the helical antenna apparatus at a distance of D=2.5 cm in the circuit of FIG. 7.

FIG. 13A is a graph showing a frequency characteristic of the voltage standing wave ratio (VSWR) in free space when no human body is located so as to be close to the helical antenna apparatus in the circuit of FIG. 7. FIG. 13B is a graph showing a frequency characteristic of the voltage standing wave ratio (VSWR) when a human body is located so as to be close to the helical antenna apparatus at a distance of D=2.5 cm in the circuit of FIG. 7. As is apparent from FIGS. 13A and 13B, it can be understood that the impedance matching state is changed by the human body located so as to be close to the helical antenna apparatus, changing the resonance frequency of the antenna apparatus.

Figure 14A:
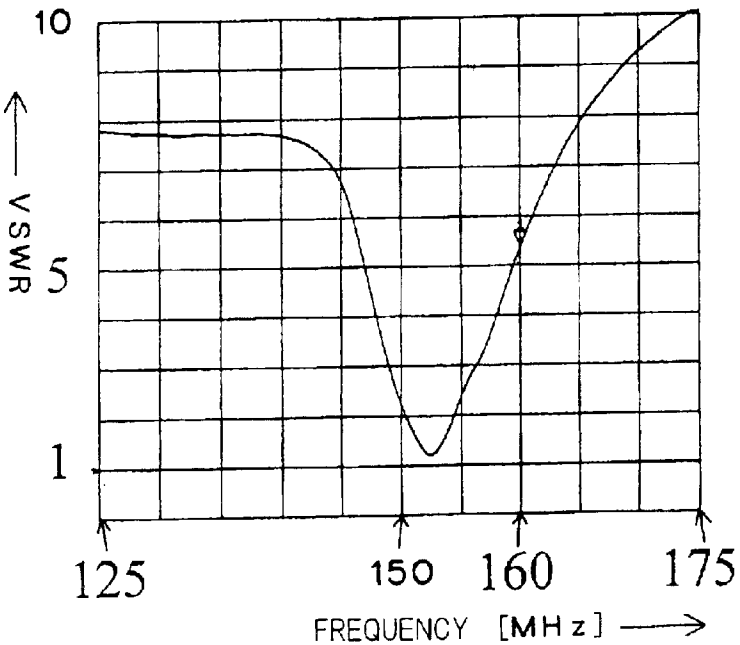
FIG. 14A is a graph showing a frequency characteristic of the voltage standing wave ratio (VSWR) before adaptive control is executed by the adaptive controller 10 when a human body is located so as to be close to the helical antenna apparatus at a distance of D=2.5 cm in the circuit of FIG. 7.
Figure 14B:
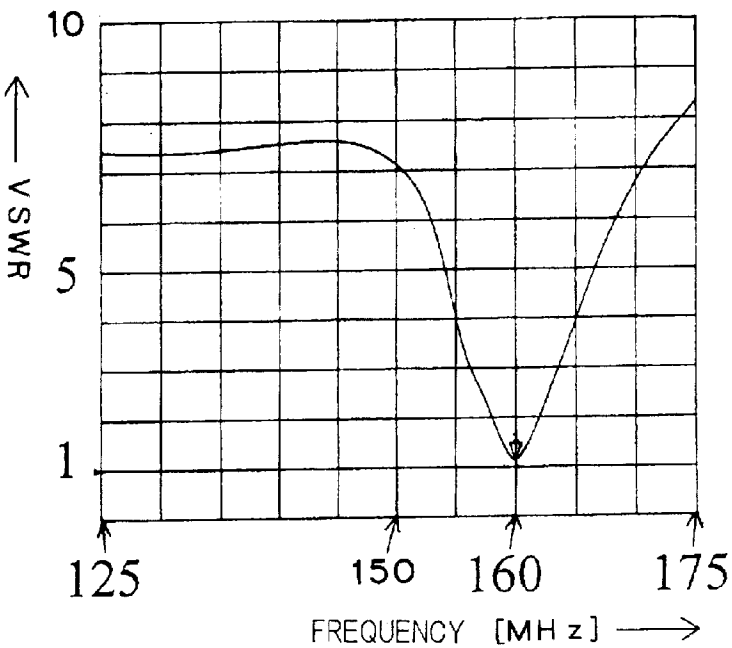
FIG. 14B is a graph showing a frequency characteristic of the voltage standing wave ratio (VSWR) after adaptive control is executed by the adaptive controller 10 when a human body is located so as to be close to the helical antenna apparatus at a distance of D=2.5 cm in the circuit of FIG. 7.

FIG. 14A is a graph showing a frequency characteristic of the voltage standing wave ratio (VSWR) before adaptive control is executed by the adaptive controller 10 when a human body is located so as to be close to the helical antenna apparatus at a distance of D=2.5 cm in the circuit of FIG. 7. FIG. 14B is a graph showing a frequency characteristic of the voltage standing wave ratio (VSWR) after adaptive control is executed by the adaptive controller 10 when a human body is located so as to be close to the helical antenna apparatus at a distance of D=2.5 cm. As is apparent from FIGS. 14A and 14B, it can be understood that the impedance matching state is changed before and after adaptive control when a human body is located so as to be close to the helical antenna apparatus, changing the resonance frequency of the antenna apparatus.

Figure 15:
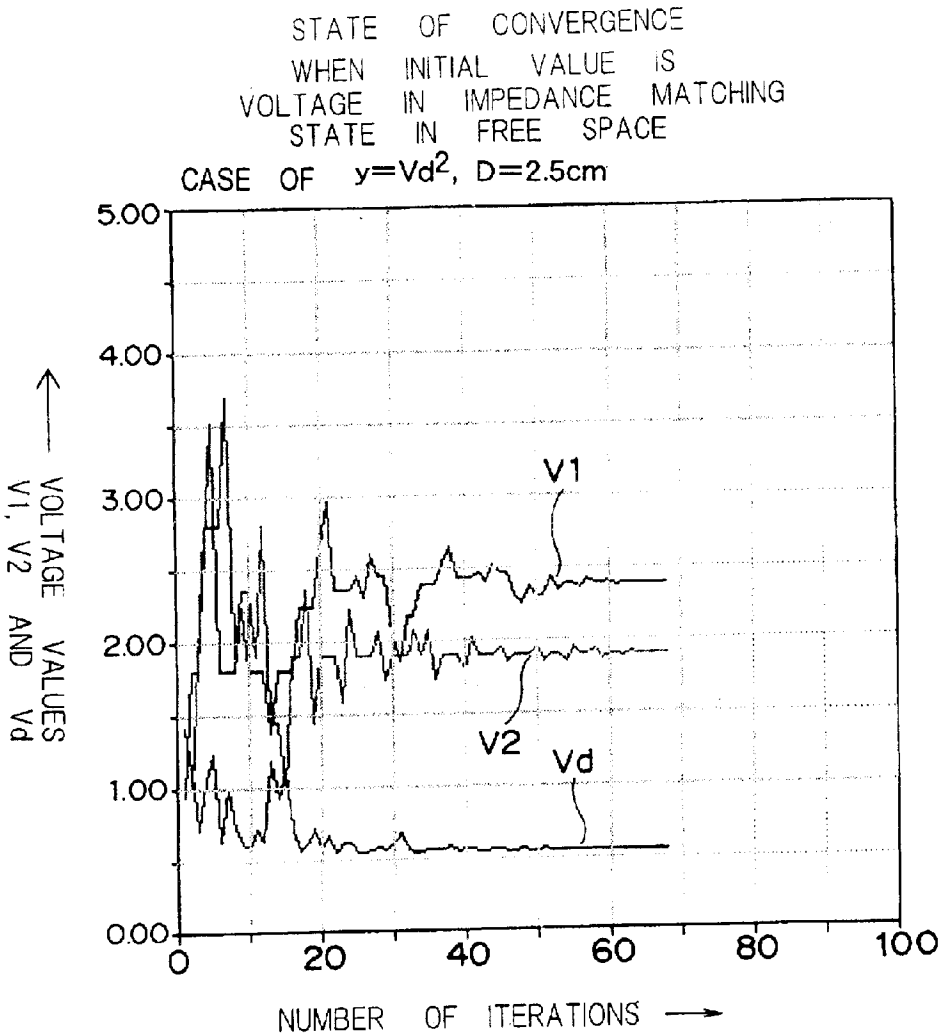
FIG. 15 is a graph showing a situation in which the voltages V1, V2 and Vd converge when the initial values of the voltage values are set to the respective voltage values in the impedance matching state in free space in the case where the adaptive control is executed by the adaptive controller 10 using the estimation function $y=Vd^{2}$ when a human body is located so as to be close to the helical antenna apparatus at a distance of D=2.5 cm in the circuit of FIG. 7.

FIG. 15 is a graph showing a situation in which the voltages V1, V2 and Vd converge when the initial values of the voltage values are set to the respective voltage values in the impedance matching state in free space in the case where the adaptive control is executed by the adaptive controller 10 using the estimation function $y=Vd^2$ when a human body is located so as to be close to the helical antenna apparatus at a distance of D=2.5 cm in the circuit of FIG. 7. As is apparent from FIG. 15, it can be understood that the voltage values V1, V2 and Vd converge onto predetermined values in free space where no human body is located so as to be close to the helical antenna apparatus.

Figure 16:
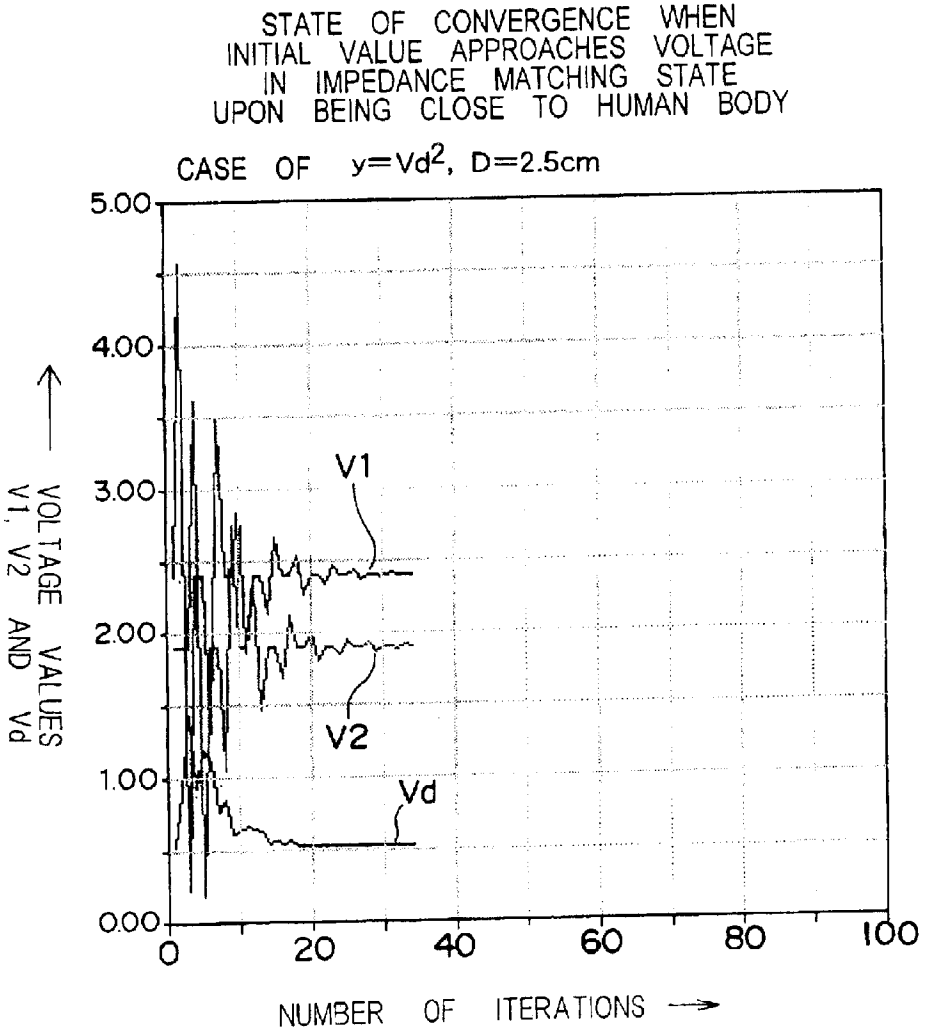
FIG. 16 is a graph showing a situation in which the voltages V1, V2 and Vd converge when the initial values of the voltage values are set to the respective voltage values in the impedance matching state when a human body is located so as to be close to the apparatus in the case where the adaptive control is executed by the adaptive controller 10 using the estimation function $y=Vd^{2}$ when a human body is located so as to be close to the helical antenna apparatus at a distance of D=2.5 cm in the circuit of FIG. 7.

FIG. 16 is a graph showing a situation in which the voltages V1, V2 and Vd converge when the initial values of the voltage values are set to the respective voltage values in the impedance matching state when a human body is located so as to be close to the apparatus in the case where the adaptive control is executed by the adaptive controller 10 using the estimation function $y=Vd^2$ when a human body is located so as to be close to the helical antenna apparatus at a distance of D=2.5 cm in the circuit of FIG. 7. Comparing FIG. 16 with FIG. 15, it can be understood that the voltage values can be converged within a smaller number of iterations (time) by setting the initial values of the voltage values to the respective voltage values in the impedance matching state when a human body is located so as to be close to the apparatus.

Figure 17:
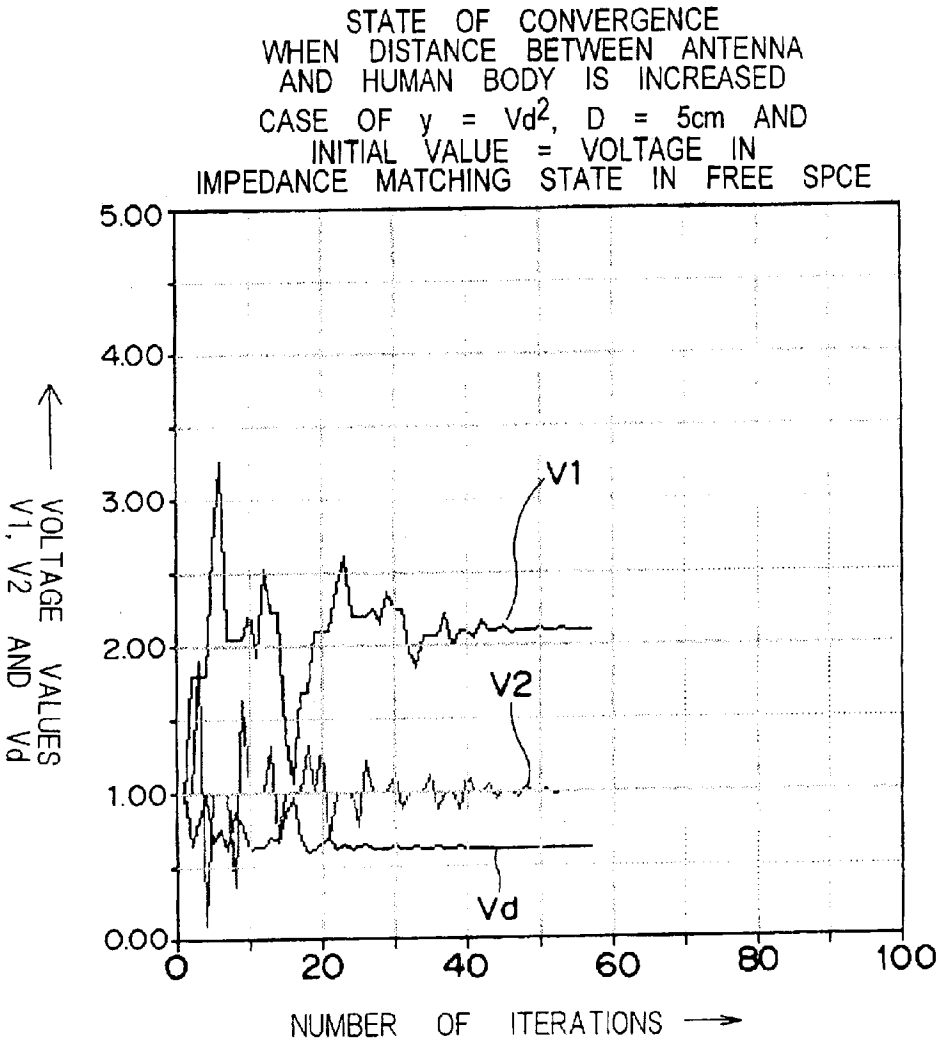
FIG. 17 is a graph showing a situation in which the voltages V1, V2 and Vd converge when the initial values of the voltage values are set to the respective voltage values in the impedance matching state in free space in the case where the adaptive control is executed by the adaptive controller 10 using the estimation function $y=Vd^2$ when a human body is located so as to be close to the helical antenna apparatus at a distance of D=5.0 cm in the circuit of FIG. 7.

FIG. 17 is a graph showing a situation in which the voltages V1, V2 and Vd converge when the initial values of the voltage values are set to the respective voltage values in the impedance matching state in free space in the case where the adaptive control is executed by the adaptive controller 10 using the estimation function $y=Vd^2$ when a human body is located so as to be close to the helical antenna apparatus at a distance of D=5.0 cm in the circuit of FIG. 7. As is apparent from FIG. 17, it can be understood that the number of iterations until the convergence becomes smaller than in the case of FIG. 15 (D=2.5 cm) when the distance between the antenna and the human body is increased.

As described above, according to the experiment of the present inventor, it was confirmed that stable convergence was achieved not depending on the distance between the antenna and the human body.

As is apparent from the experimental results of FIG. 16, it is understood that the voltage values can be converged within a smaller number of iterations (convergence time) by setting the initial values of the voltage values to the respective voltage values in the impedance matching state when a human body is located so as to be close to the apparatus. By mounting an initial value memory 11 of FIG. 21 connected to the adaptive controller 10, the adaptive control processing can be shortened with a reduced convergence time. In one example, before shipping of the apparatus from the factory which manufactures the apparatus, experimental values of the voltage values V1 and V2 of the control voltages in the impedance matching state when a human body is located so as to be close to the helical antenna apparatus (for example, D=2.5 cm) are preparatorily obtained and stored in the initial value memory 11 of FIG. 21. Then, the adaptive control is executed by using the initial values stored in the initial value memory 11 as the initial values for actually executing the adaptive control processing.

In another example, before shipping of the apparatus from the factory, (a) experimental values of the respective voltage values V1 and V2 of the control voltages in the impedance matching state when a human body is located so as to be close to the helical antenna apparatus, and (b) experimental values of the respective voltage values V1 and V2 of the control voltages in the impedance matching state when no human body is located so as to be close to the helical antenna apparatus are preparatorily obtained and stored in the initial value memory 11 of FIG. 21. When using the apparatus, the user selects one set of these two sets of experimental values by using a changeover switch inside of the input apparatus 21 of FIG. 21. In response to this, the adaptive controller 10 executes the adaptive control by using the selected initial values as the initial values for actually executing the adaptive control processing. Through these procedures, by selecting the experimental values corresponding to, for example, having telephone conversation with a portable telephone as the initial values in the above-mentioned case (a) or selecting the experimental values corresponding to, for example, electronic mail operation with a portable telephone as the initial values in the above-mentioned case (b), the user can select the initial values of the adaptive control processing according to these situations. By setting the appropriate initial values by selection by the user, the adaptive control processing can be shortened with a reduced convergence time.

Although the user selects the initial value in the above-mentioned example, it is acceptable to measure the convergence time for the adaptive control from the initial value to the value in the impedance matching state by the adaptive controller 10 when the adaptive control processing is executed and automatically selects either one of the two sets of the initial values, based on the measured convergence time measured by the adaptive controller 10, as described hereinbelow. A concrete example of the operation is described below.

It is assumed that the experimental values of the respective control voltages V1 and V2 for achieving impedance matching in free space (when no human body is located so as to be close to the apparatus) are (V1f, V2f) and the experimental values of the control voltages V1 and V2 for achieving impedance matching when a human body is located so as to be close to the apparatus (hereinafter referred to as a "time when a human body is located so as to be close to the apparatus") are (V1h, V2h). A convergence time required for executing adaptive control by transmitting in free space with the experimental values (V1f, V2f) of the control voltages V1 and V2 used as the initial values is assumed to be Tfa. Further, a convergence time required for executing the adaptive control by transmission when a human body is located so as to be close to the apparatus with the experimental values (V1f, V2f) of the control voltages V1 and V2 used as the initial values is assumed to be Tha.

On the other hand, a convergence time required for executing the adaptive control by transmitting in free space with the experimental values (V1h, V2h) of the control voltages V1 and V2 as the initial values is assumed to be Tfb. Further, a convergence time required for executing the adaptive control by transmission when a human body is located so as to be close to the apparatus with the experimental values (V1h, V2h) of the control voltages V1 and V2 used as the initial values is assumed to be Thb. At this time, Tfa<Tha and Tfb>Thb. It is assumed that Tfa, Tha, Tfb and Thb have been measured in the factory before shipping from the factory.

It is assumed that the adaptive controller 10 consistently measures the convergence time when the user makes transmission. The convergence time can be measured by counting the number of operating clock generated by the adaptive controller 10, for a time interval from the start of transmission to the end of convergence (when the adaptive control processing is completed, namely, when the ending conditions in step S7 of FIG. 8 are satisfied).

A learning function to speed up the convergence time of the adaptive control processing can be achieved according to the following procedure. It is now assumed that the experimental values (V1f, V2f) of the control voltages V1 and V2 at the n-th transmission (n is an arbitrary natural number) are used as the initial values. If the convergence time is Tfa when the user makes the n-th transmission, then the adaptive controller 10 judges that the apparatus is in free space and selects the experimental values (V1f, V2f) as the initial values of the control voltages V1 and V2 at the (n+1)-th transmission. On the other hand, if the convergence time is Tha when the user makes the n-th transmission, then the adaptive controller 10 judges that a human body is located so as to be close to the apparatus, and then, selects the experimental values (V1h, V2h) as the initial values of the control voltages V1 and V2 at the (n+1)-th transmission. At this time, since the convergence time has some variation every transmission, it is most rational to substantially provide Tsa=(Tfa+Tha)/2, or a middle point between the time Tfa and the time Tha as a threshold value, and then judge that the apparatus is in free space when the convergence time is smaller than the time Tsa and that a human body is located so as to be close to the apparatus when the convergence time is greater than the time Tsa. In the present concrete example, the control is executed so as to preparatorily store the above-mentioned two sets of experimental values in the initial value memory 11 of FIG. 21, store the initial values that are currently selected and set and rewrite the initial value of the latter when the adaptive controller 10 judges that the state is changed.

Further, also in the case where the initial values of the control voltages V1 and V2 at the n-th transmission (n is an arbitrary natural number) are (V1h, V2h), a similar processing is executed. That is, if the convergence time is Tfb when the user makes the n-th transmission, then the adaptive controller 10 judges that the apparatus is in free space and selects and sets the experimental values (V1f, V2f as the initial values of the control voltages V1 and V2 at the (n+1)-th transmission. On the other hand, if the convergence time is Thb when the user makes the n-th transmission, then the adaptive controller 10 judges that a human body is located so as to be close to the apparatus and selects and sets the experimental values (V1f, V2h) as the initial values of the control voltages V1 and V2 at the (n+1)-th transmission. At this time, since the convergence time has some variation every trial transmission, it is most rational to substantially provide Tsb=(Tfb+Thb)/2, or a middle point between Tfb and Thb as a threshold value, and judge that the apparatus is in free space when the convergence time is greater than the time Tsb and that a human body is located so as to be close to the apparatus when the convergence time is smaller than the time Tsb.

By the above-mentioned operation, even if the state of the radio communication apparatus is changed from the state in free space to the state in which a human body is located so as to be close to the apparatus or from the state in which a human body is located so as to be close to the apparatus to the state in free space, the adaptive controller 10 is able to judge which state the apparatus is in by the transmission of the first occurrence of change and execute the adaptive control processing by using the optimum initial values of the control voltages V1 and V2 at the next transmission. Therefore, the convergence time can be sped up by the learning through these judging processes.

In the above-mentioned preferred embodiment, the initial values of the control voltages V1 and V2 are stored in the initial value memory 11. However, the present invention is not limited to this, and it is acceptable to store the initial values of the corresponding capacitance values in place of the initial values of the control voltages V1 and V2 and convert these values into control voltages V1 and V2 by a predetermined conversion table when the adaptive control is executed.

Modified Preferred Embodiment of Third Preferred Embodiment

Figure 18:
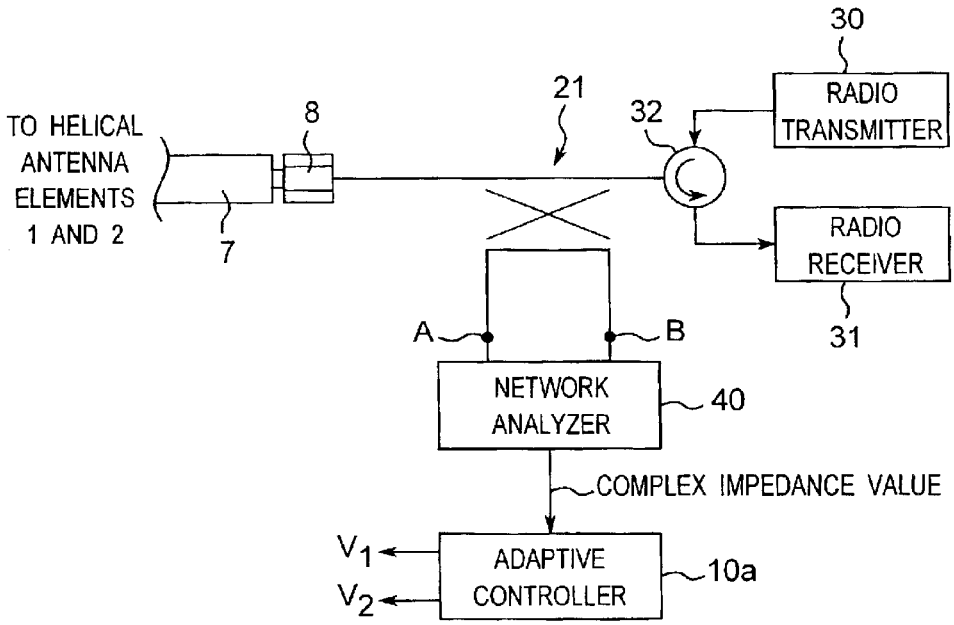
FIG. 18 is a block diagram showing a construction of a part of the helical antenna apparatus according to a modified preferred embodiment of the third preferred embodiment.

FIG. 18 is a block diagram showing a construction of a part of a helical antenna apparatus according to a modified preferred embodiment of the third preferred embodiment.

Referring to FIG. 18, a four-terminal directional coupler 21 is inserted between the radio transmitter 30 and the input connector 8, and a part of the signal of the travelling-wave power and a part of the signal of the reflected wave power are detected by the directional coupler 21. The signal of the former signal of the travelling-wave power is inputted to a terminal A of a network analyzer 40 and made to be used as a reference signal of impedance measurement, and the latter signal of the reflected wave power is inputted to a terminal B of the network analyzer 40 and made to be used as a measurement signal of impedance measurement. The network analyzer 40 measures the complex impedance value of the inputted measurement signals with respect to an input reference signal, and outputs the resulting signal having the measured complex impedance value to an adaptive controller 10*a*. In response to this, the adaptive controller 10*a* calculates the control voltages V1 and V2, so that the complex impedance value becomes, for example, a pure resistance of 50Ω, based on the measured complex impedance value and applies the resulting voltages to the variable capacitance diodes D11 to D22. By this operation, the adaptive control is executed, so that the input impedance Zin when the helical antenna elements 1 and 2 are seen from the input connector 8 substantially coincides with the complex conjugate of the input impedance Za of the helical antenna elements 1 and 2.

It is to be noted that the modified preferred embodiment of the third preferred embodiment can be also applied to the other preferred embodiments.

Fourth Preferred Embodiment

Figure 19:
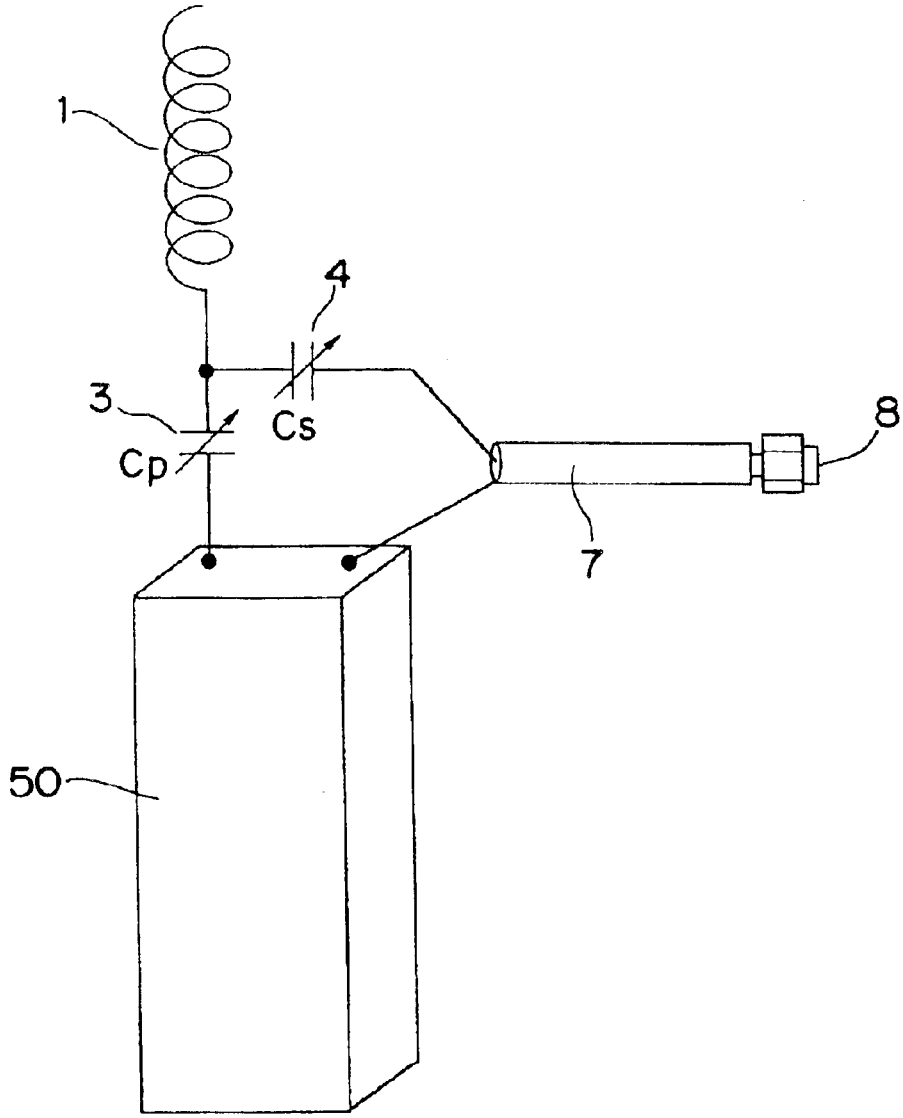
FIG. 19 is a circuit diagram and a perspective view showing a construction of a helical antenna apparatus according to a fourth preferred embodiment of the present invention.

FIG. 19 is a circuit diagram and a perspective view showing a construction of a helical antenna apparatus according to the fourth preferred embodiment of the present invention. The helical antenna apparatus of this fourth preferred embodiment shows a construction provided with only one helical antenna element 1.

Referring to FIG. 19, one terminal of the helical antenna element 1 is connected to a radio transceiver housing 50 constituted of a conductor of a metal or the like via a variable capacitance element 3 of a capacitance value Cp, and is connected to the central conductor of the coaxial cable 7 of an unbalanced feeder line via a variable capacitance element 4 of a capacitance value Cs. It is to be noted that the grounding conductor of the coaxial cable 7 is connected to the radio transceiver housing 50.

In the preferred embodiment constructed as above, the helical antenna element 1 operates as a monopole type helical antenna element provided on the radio transceiver housing 50. That is, considering an image circuit included in the radio transceiver housing 50, the helical antenna apparatus of FIG. 19 is electrically equivalent to FIG. 1. Therefore, the operation of the helical antenna apparatus of FIG. 19 is similar to those of the first to third preferred embodiments, which have been described hereinabove. In this case, the variable capacitance elements 3 and 4 of FIG. 19 may be, for example, the variable capacitance elements of FIG. 6 or 7, and their capacitance values Cp and Cs are adaptively controlled by the adaptive controller 10 or 10*a* so as to achieve the above-mentioned impedance matching state.

The Other Modified Preferred Embodiments

In the above-mentioned preferred embodiments, the variable capacitance elements 3, 4 and 5 are constituted by the switchover among the plurality of capacitors or the variable capacitance diodes. However, the present invention is not limited to this, and it is acceptable to employ a piezoelectric capacitor in which a dielectric material is interposed between the electrodes of a piezoelectric element. With this arrangement, the withstand voltage can be increased.

Advantageous Effects of the Preferred Embodiments

As described in detail above, according to the helical antenna apparatus of the preferred embodiment according to the present invention, there is provided a helical antenna apparatus connected to either one of a balanced feeder line and a balanced port of a balanced to unbalanced transformer of a feeder circuit. The helical antenna apparatus includes a first helical antenna element, a second helical antenna element, and first to third variable capacitance elements. The first variable capacitance element is connected between the first helical antenna element and the second helical antenna element, and the second variable capacitance element is connected between (a) either one of the balanced feeder line and a first terminal of the balanced port of the balanced to unbalanced transformer, and (b) the first helical antenna element. The third variable capacitance element is connected between (a) either one of the balanced feeder line and a second terminal of the balanced port of the balanced to unbalanced transformer, and (b) the second helical antenna element. Accordingly, by appropriately setting the respective capacitance values of the first to third variable capacitance elements even when a human body is located so as to be close to the helical antenna apparatus, impedance matching can be achieved, so that the input impedance of the helical antenna apparatus substantially coincides with the input impedance of the first and second helical antenna elements. With this arrangement, the helical antenna apparatus can be used in a wide band, and the power loss due to impedance mismatching when a human body is located so as to be close to the apparatus can be reduced.

Further, the above-mentioned helical antenna preferably further includes a detector and an adaptive controller. The detector is connected between (a) either one of the balanced feeder line and the feeding port of the balanced to unbalanced transformer, and (b) a radio transmitter. The detector detects at least one detection value of a reflection signal reflected from the first and second helical antenna elements when the first and second helical antenna elements are fed with a transmission signal from the radio transmitter, a reflection coefficient and a voltage standing wave ratio. The adaptive controller adaptively controls respective capacitance values of the first, second and third variable capacitance elements, so that either one of the detected detection value and a predetermined estimation function including the reflection signal becomes substantially minimized. Accordingly, by automatically adaptively controlling the respective capacitance values of the first to third variable capacitance elements even when a human body is located so as to be close to the helical antenna apparatus, impedance matching can be achieved, so that the input impedance of the helical antenna apparatus substantially coincides with the input impedance of the first and second helical antenna elements. With this arrangement, the helical antenna apparatus can be used in a wide band, and the power loss due to impedance mismatching when a human body is located so as to be close to the apparatus can be reduced.

In this case, the estimation function is characterized by being expressed by a predetermined power of the reflection signal such as a third or more power thereof, or the square of the reflection signal. With this arrangement, the adaptive control processing can be converged reliably at a higher speed.

Moreover, the above-mentioned helical antenna apparatus preferably further includes a detector, a measurement device, and an adaptive controller. The detector is connected between the balanced feeder line or the feeding port of the balanced to unbalanced transformer and a radio transmitter, and the detector detects a travelling-wave signal and a reflected wave signal when the first and second helical antenna elements are fed with a transmission signal from the radio transmitter. The measurement device measures a complex impedance value, based on the travelling-wave signal and the reflected wave signal detected by detector. The adaptive controller adaptively controls the respective capacitance values of the first, second and third variable capacitance elements, based on the measured complex impedance value, so that the measured complex impedance value substantially coincides with the complex conjugate of the input impedance of the first and second helical antenna elements. Accordingly, by automatically adaptively controlling the respective capacitance values of the first to third variable capacitance elements even when a human body is located so as to be close to the helical antenna apparatus, impedance matching can be achieved, so that the input impedance of the helical antenna apparatus substantially coincides with the complex conjugate of the input impedance of the first and second helical antenna elements. With this arrangement, the helical antenna apparatus can be used in a wide band, and the power loss due to impedance mismatching when a human body is located so as to be close to the apparatus can be reduced.

Moreover, according to the helical antenna apparatus of the preferred embodiment according to the present invention, there is provided a helical antenna apparatus connected to an unbalanced feeder line, and provided on a radio communication apparatus housing. The helical antenna apparatus includes a helical antenna element, and first and second variable capacitance elements. The first variable capacitance element is connected between the helical antenna element and the radio communication apparatus housing, and the second variable capacitance element connected between the unbalanced feeder line and the helical antenna element. Accordingly, by appropriately setting the respective capacitance values of the first and second variable capacitance elements even when a human body is located so as to be close to the helical antenna apparatus, impedance matching can be achieved, so that the input impedance of the helical antenna apparatus substantially coincides with the input impedance of the helical antenna element. With this arrangement, the apparatus can be used in a wide band, and the power loss due to impedance mismatching when a human body is located so as to be close to the apparatus can be reduced.

The above-mentioned helical antenna apparatus preferably further includes a detector and an adaptive controller. The detector is connected between the unbalanced feeder line and a radio transmitter, and the detector detects at least one detection value of a reflection signal reflected from the helical antenna element when the helical antenna element is fed with a transmission signal from the radio transmitter, a reflection coefficient and a voltage standing wave ratio. The adaptive controller adaptively controls the respective capacitance values of the first and second variable capacitance elements, so that either one of the detected detection value and a predetermined estimation function that includes the reflection signal becomes substantially minimized. Accordingly, by automatically adaptively controlling the respective capacitance values of the first and second variable capacitance elements even when a human body is located so as to be close to the helical antenna apparatus, impedance matching can be achieved, so that the input impedance of the helical antenna apparatus substantially coincides with the input impedance of the helical antenna element. With this arrangement, the helical antenna apparatus can be used in a wide band, and the power loss due to impedance mismatching when a human body is located so as to be close to the apparatus can be reduced.

In this case, the estimation function is characterized by being expressed by a predetermined power of the reflection signal such as a third or more power thereof, or the square of the reflection signal. With this arrangement, the adaptive control processing can be converged reliably at a higher speed.

The above-mentioned helical antenna apparatus preferably further includes a detector, a measurement device, and an adaptive controller. The detector is connected between the unbalanced feeder line and a radio transmitter, and the detector detects a travelling-wave signal and a reflected wave signal when the helical antenna element is fed with a transmission signal from the radio transmitter. The measurement device measures a complex impedance value, based on the travelling-wave signal and the reflected wave signal detected by the detector. The adaptive controller adaptively controls the respective capacitance values of the first and second variable capacitance elements, based on the measured complex impedance value, so that the measured complex impedance value substantially coincides with the complex conjugate of the input impedance of the helical antenna element. Accordingly, by automatically adaptively controlling the respective capacitance values of the first and second variable capacitance elements even when a human body is located so as to be close to the helical antenna apparatus, impedance matching can be achieved, so that the input impedance of the helical antenna apparatus substantially coincides with the input impedance of the helical antenna element. With this arrangement, the helical antenna apparatus can be used in a wide band, and the power loss due to impedance mismatching when a human body is located so as to be close to the apparatus can be reduced.

Moreover, in the above-mentioned helical antenna apparatus, the adaptive controller preferably executes the adaptive control by using as initial values, the respective capacitance values of the variable capacitance elements or experimental values of respective control voltages for setting the respective capacitance values for the variable capacitance elements in an impedance matching state when a human body is located so as to be close to the helical antenna apparatus. Accordingly, when a human body is located so as to be close to the helical antenna apparatus, the actual convergence time for the achievement of the impedance matching state can be remarkably reduced.

Furthermore, the above-mentioned helical antenna apparatus preferably further includes a selector for selecting either one of the following, and an adaptive controller:

(a) either one of first experimental values of the respective capacitance values of the variable capacitance elements, and first experimental values of respective control voltages for setting the respective capacitance values for the variable capacitance elements in an impedance matching state when a human body is located so as to be close to the helical antenna apparatus; and (b) either one of second experimental values of the respective capacitance values of the variable capacitance elements, and second experimental values of respective control voltages for setting the respective capacitance values for the variable capacitance elements in the impedance matching state when no human body is located so as to be close to the helical antenna apparatus.

The adaptive controller executes the adaptive control by using as initial values, either one of the first experimental values and the second experimental values selected by the selector. In this case, the selector is, for example, an input apparatus operated by the user. Accordingly, switchover among the initial values can be achieved according to the situation of the helical antenna apparatus, and the actual convergence time for the achievement of the impedance matching state can be remarkably reduced.

Furthermore, the above-mentioned helical antenna apparatus preferably further includes a timing controller for timing a convergence time for achieving the adaptive control from the initial values to the values of the impedance matching state by the adaptive controller. The selector selects either one of the first experimental values and the second experimental values as the initial values, based on the convergence time timed by the timing controller. Accordingly, the initial value can be automatically switched by learning in accordance with the situation of the helical antenna apparatus, and the actual convergence time for the achievement of the impedance matching state can be remarkably reduced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A helical antenna apparatus connected to one of a balanced feeder line and a balanced port of a balanced to unbalanced transformer of a feeder circuit, said helical antenna apparatus comprising:

a first helical antenna element;

a second helical antenna element;

a first variable capacitance element connected between said first helical antenna element and said second helical antenna element;

a second variable capacitance element connected between (a) one of the balanced feeder line and a first terminal of the balanced port of the balanced to unbalanced transformer, and (b) said first helical antenna element; and a third variable capacitance element connected between (a) one of the balanced feeder line and a second terminal of the balanced port of the balanced to unbalanced transformer, and (b) said second helical antenna element.

2. The helical antenna apparatus as claimed in claim 1, further comprising:

a detector connected between (a) one of the balanced feeder line and the feeding port of the balanced to unbalanced transformer, and (b) a radio transmitter, said detector being operable to detect at least one detection value of a reflection signal reflected from said first and second helical antenna elements when said first and second helical antenna elements are fed with a transmission signal from the radio transmitter, a reflection coefficient and a voltage standing wave ratio; and an adaptive controller operable to adaptively control respective capacitance values of said first, second and third variable capacitance elements, so that one of the at least one detected detection value and a predetermined estimation function including the reflection signal becomes substantially minimized.

3. The helical antenna apparatus as claimed in claim 2, wherein the estimation function is expressed by a predetermined power of the reflection signal.

4. The helical antenna apparatus as claimed in claim 2, wherein the estimation function is expressed by a square of the reflection signal.

5. The helical antenna apparatus as claimed in claim 2, wherein said adaptive controller executes adaptive control by using as initial values, one of (a) experimental values of respective capacitance values of said first, second and third variable capacitance elements, and (b) experimental values of respective control voltages for setting the respective capacitance values of said first, second and third variable capacitance elements, in an impedance matching state in which one of the at least one detected detection value and a value of the estimation function becomes substantially minimized when a human body is located so as to be close to said helical antenna apparatus.

6. The helical antenna apparatus as claimed in claim 2, further comprising:

a selector operable to select one of:

(a) one of first experimental values of respective capacitance values of said first, second and third variable capacitance elements, and first experimental values of respective control voltages for setting the respective capacitance values of said first, second and third variable capacitance elements, in an impedance matching state in which the at least one detected detection value or a value of the estimation function becomes substantially minimized when a human body is located so as to be close to said helical antenna apparatus, and (b) one of second experimental values of respective capacitance values of said first, second and third variable capacitance elements, and second experimental values of respective control voltages for setting the respective capacitance values of said first, second and third variable capacitance elements, in an impedance matching state when no human body is located so as to be close to said helical antenna apparatus, and wherein said adaptive controller executes the adaptive control by using one of the first experimental values and the second experimental values selected as initial values by said selector.

7. The helical antenna apparatus as claimed in claim 6, wherein said selector is an input apparatus operated by a user.

8. The helical antenna apparatus as claimed in claim 6, further comprising a timing controller operable to time a convergence time for achieving the adaptive control from the initial values to values of the impedance matching state by said adaptive controller, and wherein said selector selects one of the first experimental values and the second experimental values as the initial values, based on the convergence time timed by said timing controller.

9. The helical antenna apparatus as claimed in claim 1, further comprising:

a detector connected between (a) one of the balanced feeder line and a feeding port of the balanced to unbalanced transformer and (b) a radio transmitter, said detector being operable to detect a travelling-wave signal and a reflected wave signal when said first and second helical antenna elements are fed with a transmission signal from the radio transmitter;

a measurement device operable to measure a complex impedance value, based on the travelling-wave signal and the reflected wave signal detected by said detector; and an adaptive controller operable to adaptively control respective capacitance values of said first, second and third variable capacitance elements, based on the measured complex impedance value, so that the measured complex impedance value substantially coincides with a complex conjugate of an input impedance of said first and second helical antenna elements.

10. The helical antenna apparatus as claimed in claim 9, wherein said adaptive controller executes the adaptive control by using as initial values, one of (a) the respective capacitance values of said first, second and third variable capacitance elements, and (b) experimental values of respective control voltages for setting the respective capacitance values of said first, second and third variable capacitance elements, in an impedance matching state in which the measured complex impedance value substantially coincides with the complex conjugate of the input impedance of said first and second helical antenna elements when a human body is located so as to be close to said helical antenna apparatus.

11. The helical antenna apparatus as claimed in claim 9, further comprising:

a selector operable to select one of:

(a) one of first experimental values of respective capacitance values of said first, second and third variable capacitance elements, and first experimental values of respective control voltages for setting the respective capacitance values of said first, second and third variable capacitance elements, in an impedance matching state in which the measured complex impedance value substantially coincides with the complex conjugate of the input impedance of said first and second helical antenna elements when a human body is located so as to be close to said helical antenna apparatus, and (b) one of second experimental values of respective capacitance values of said first, second and third variable capacitance elements, and second experimental values of respective control voltages for setting the respective capacitance values of said first, second and third variable capacitance elements, in the impedance matching state when no human body is located so as to be close to said helical antenna apparatus, and wherein said adaptive controller executes the adaptive control by using one of the first experimental values and the second experimental values selected as initial values by said selector.

12. The helical antenna apparatus as claimed in claim 11, wherein said selector is an input apparatus operated by a user.

13. The helical antenna apparatus as claimed in claim 11, further comprising a timing controller operable to time a convergence time for achieving the adaptive control from the initial values to the values of the impedance matching state by said adaptive controller, and wherein said selector selects one of the first experimental values and the second experimental values as the initial values, based on the convergence time timed by said timing controller.

14. The helical antenna apparatus as claimed in claim 1, wherein each of said first, second and third variable capacitance elements is made of a variable capacitance diode.

15. The helical antenna apparatus as claimed in claim 1, wherein each of said first, second and third variable capacitance elements comprises a plurality of capacitors, and a switch operable to selectively switch among said plurality of capacitors so as to select one of said plurality of capacitors.

16. The helical antenna apparatus as claimed in claim 15, wherein said switch is an electronic switch.

17. The helical antenna apparatus as claimed in claim 1, wherein said first and second helical antenna elements have same size parameters, and wherein said second and third variable capacitance elements have same capacitance value.

18. A helical antenna apparatus connected to an unbalanced feeder line, and provided on a radio communication apparatus housing, said helical antenna apparatus comprising:

a helical antenna element;

a first variable capacitance element connected between said helical antenna element and the radio communication apparatus housing; and a second variable capacitance element connected between the unbalanced feeder line and said helical antenna element.

19. The helical antenna apparatus as claimed in claim 18, further comprising:

a detector connected between the unbalanced feeder line and a radio transmitter, said detector operable to detect at least one detection value of a reflection signal reflected from said helical antenna element when said helical antenna element is fed with a transmission signal from the radio transmitter, a reflection coefficient and a voltage standing wave ratio; and an adaptive controller operable to adaptively control respective capacitance values of said first and second variable capacitance elements, so that one of the at least one detected detection value and a predetermined estimation function including the reflection signal becomes substantially minimized.

20. The helical antenna apparatus as claimed in claim 19, wherein the estimation function is expressed by a predetermined power of the reflection signal.

21. The helical antenna apparatus as claimed in claim 19, wherein the estimation function is expressed by a square of the reflection signal.

22. The helical antenna apparatus as claimed in claim 19, wherein said adaptive controller executes adaptive control by using as initial values, one of (a) respective capacitance values of said first and second variable capacitance elements, and (b) experimental values of respective control voltages for setting the respective capacitance values of said first and second variable capacitance elements, in an impedance matching state in which one of the at least one detected detection value and a value of the estimation function becomes substantially minimized when a human body is located so as to be close to said helical antenna apparatus.

23. The helical antenna apparatus as claimed in claim 19, further comprising:

a selector operable to select one of:

(a) one of first experimental values of respective capacitance values of said first and second variable capacitance elements, and first experimental values of respective control voltages for setting the respective capacitance values of said first and second variable capacitance elements, in an impedance matching state in which one of the at least one detected detection value and a value of the estimation function becomes substantially minimized when a human body is located so as to be close to said helical antenna apparatus, and (b) one of second experimental values of respective capacitance values of said first and second variable capacitance elements, and second experimental values of respective control voltages for setting the respective capacitance values of said first and second variable capacitance elements, in an impedance matching state when no human body is located so as to be close to said helical antenna apparatus, and wherein said adaptive controller executes the adaptive control by using one of the first experimental values and the second experimental values selected as initial values by said selector.

24. The helical antenna apparatus as claimed in claim 23, wherein said selector is an input apparatus operated by a user.

25. The helical antenna apparatus as claimed in claim 23, further comprising a timing controller operable to time a convergence time for achieving the adaptive control from the initial values to values of the impedance matching state by said adaptive controller, and wherein said selector selects one of the first experimental values and the second experimental values as the initial values, based on the convergence time timed by said timing controller.

26. The helical antenna apparatus as claimed in claim 18, further comprising:

a detector connected between the unbalanced feeder line and a radio transmitter, said detector being operable to detect a travelling-wave signal and a reflected wave signal when said helical antenna element is fed with a transmission signal from the radio transmitter;

a measurement device operable to measure a complex impedance value, based on the travelling-wave signal and the reflected wave signal detected by said detector; and an adaptive controller operable to adaptively control the respective capacitance values of said first and second variable capacitance elements, based on the measured complex impedance value, so that the measured complex impedance value substantially coincides with a complex conjugate of an input impedance of said helical antenna element.

27. The helical antenna apparatus as claimed in claim 26, wherein said adaptive controller executes the adaptive control by using as initial values, one of (a) the respective capacitance values of said first and second variable capacitance elements and (b) experimental values of respective control voltages for setting the respective capacitance values of said first and second variable capacitance elements, in an impedance matching state in which the measured complex impedance value substantially coincides with the complex conjugate of the input impedance of said helical antenna element when a human body is located so as to be close to said helical antenna apparatus.

28. The helical antenna apparatus as claimed in claim 26, further comprising:

a selector operable to select one of:

(a) one of first experimental values of respective capacitance values of said first and second variable capacitance elements, and first experimental values of respective control voltages for setting the respective capacitance values of said first and second variable capacitance elements, in an impedance matching state in which the measured complex impedance value substantially coincides with the complex conjugate of the input impedance of said helical antenna element when a human body is located so as to be close to said helical antenna apparatus, and (b) one of second experimental values of respective capacitance values of said first and second variable capacitance elements, and second experimental values of respective control voltages for setting the respective capacitance values of said first and second variable capacitance elements, in the impedance matching state when no human body is located so as to be close to said helical antenna apparatus, and wherein said adaptive controller executes the adaptive control by using one of the first experimental values and the second experimental values selected as initial values by said selector.

29. The helical antenna apparatus as claimed in claim 28, wherein said selector is an input apparatus operated by a user.

30. The helical antenna apparatus as claimed in claim 28, further comprising a timing controller operable to time a convergence time for achieving the adaptive control from the initial values to the values of the impedance matching state by said adaptive controller, and wherein said selector selects one of the first experimental values and the second experimental values as the initial values, based on the convergence time timed by said timing controller.

31. The helical antenna apparatus as claimed in claim 18, wherein each of said first and second variable capacitance elements is made of a variable capacitance diode.

32. The helical antenna apparatus as claimed in claim 18, wherein each of said first and second variable capacitance elements comprises a plurality of capacitors, and a switch operable to selectively switch among said plurality of capacitors so as to select one of said plurality of capacitors.

33. The helical antenna apparatus as claimed in claim 32, wherein said switch is an electronic switch.

34. A radio communication apparatus comprising:

a helical antenna apparatus connected to one of a balanced feeder line and a balanced port of a balanced to unbalanced transformer of a feeder circuit;

a radio transmitter connected to said helical antenna apparatus; and a radio receiver connected to said helical antenna apparatus, wherein said helical antenna apparatus comprises:

a first helical antenna element;

a second helical antenna element;

a first variable capacitance element connected between said first helical antenna element and said second helical antenna element;

a second variable capacitance element connected between (a) one of the balanced feeder line and a first terminal of the balanced port of the balanced to unbalanced transformer, and (b) said first helical antenna element; and a third variable capacitance element connected between (a) one of the balanced feeder line and a second terminal of the balanced port of the balanced to unbalanced transformer, and (b) said second helical antenna element.

35. The radio communication apparatus as claimed in claim 34, wherein said helical antenna apparatus further comprises:

a detector connected between (a) one of the balanced feeder line and the feeding port of the balanced to unbalanced transformer, and (b) a radio transmitter, said detector being operable to detect at least one detection value of a reflection signal reflected from said first and second helical antenna elements when said first and second helical antenna elements are fed with a transmission signal from said radio transmitter, a reflection coefficient and a voltage standing wave ratio; and an adaptive controller operable to adaptively control respective capacitance values of said first, second and third variable capacitance elements, so that one of the at least one detected detection value and a predetermined estimation function including the reflection signal becomes substantially minimized.

36. The radio communication apparatus as claimed in claim 35, further comprising a controller apparatus operable to control operation of said radio transmitter and said radio receiver, said controller apparatus including said adaptive controller.

37. A radio communication apparatus comprising:

a helical antenna apparatus connected to an unbalanced feeder line, and provided on a radio communication apparatus housing;

a radio transmitter connected to said helical antenna apparatus; and a radio receiver connected to said helical antenna apparatus, wherein said helical antenna apparatus comprises:

a helical antenna element;

a first variable capacitance element connected between said helical antenna element and the radio communication apparatus housing; and a second variable capacitance element connected between the unbalanced feeder line and said helical antenna element.

38. The radio communication apparatus as claimed in claim 37, wherein said helical antenna apparatus further comprises:

a detector connected between the unbalanced feeder line and a radio transmitter, said detector being operable to detect at least one detection value of a reflection signal reflected from said helical antenna element when said helical antenna element is fed with a transmission signal from said radio transmitter, a reflection coefficient and a voltage standing wave ratio; and an adaptive controller operable to adaptively control respective capacitance values of said first and second variable capacitance elements, so that one of the at least one detected detection value and a predetermined estimation function including the reflection signal becomes substantially minimized.

39. The radio communication apparatus as claimed in claim 38, further comprising a controller apparatus operable to control operation of said radio transmitter and said radio receiver, said controller apparatus including said adaptive controller.

* * * * *